US010243256B2

(12) United States Patent
Makimura et al.

(10) Patent No.: US 10,243,256 B2
(45) Date of Patent: Mar. 26, 2019

(54) ANTENNA DEVICE AND ANTENNA MANUFACTURING METHOD

(71) Applicant: Mitsubishi Electric Corporation, Tokyo (JP)

(72) Inventors: Hidetoshi Makimura, Tokyo (JP); Kengo Nishimoto, Tokyo (JP); Toru Fukasawa, Tokyo (JP); Kazunori Takahashi, Tokyo (JP); Kazuya Hojo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 144 days.

(21) Appl. No.: 15/110,492

(22) PCT Filed: Aug. 4, 2014

(86) PCT No.: PCT/JP2014/004060
§ 371 (c)(1),
(2) Date: Jul. 8, 2016

(87) PCT Pub. No.: WO2015/159327
PCT Pub. Date: Oct. 22, 2015

(65) Prior Publication Data

US 2016/0336642 A1 Nov. 17, 2016

(30) Foreign Application Priority Data

Apr. 17, 2014 (WO) ..... PCT/JP2014/002192

(51) Int. Cl.
*H01Q 1/24* (2006.01)
*H01Q 1/32* (2006.01)
(Continued)

(52) U.S. Cl.
CPC ..... *H01Q 1/24* (2013.01); *H01Q 1/3241* (2013.01); *H01Q 1/38* (2013.01); *H01Q 1/42* (2013.01);
(Continued)

(58) Field of Classification Search
CPC ..... H01Q 1/3241; H01Q 7/00; H01Q 7/005; H01Q 7/02; H01Q 7/04; H01Q 7/06; H01Q 7/08
See application file for complete search history.

(56) References Cited

U.S. PATENT DOCUMENTS 5,673,054 A 9/1997 Hama
5,771,445 A 6/1998 Harano
(Continued)

FOREIGN PATENT DOCUMENTS

JP 05-183318 A 7/1993
JP 08-023218 A 1/1996
(Continued)

OTHER PUBLICATIONS

Communication dated Mar. 28, 2017, issued from the Japan Patent Office in counterpart Application No. 2016-513499.
(Continued)

*Primary Examiner* — Daniel Munoz
(74) *Attorney, Agent, or Firm* — Sughrue Mion, PLLC; Richard C. Turner

(57) ABSTRACT

The present invention is characterized by an antenna device including: a circuit board; a circuit pattern formed by a conductor on a surface of the circuit board; and a minute loop antenna mounted on the circuit board and formed in a loop shape by a conductor having two end portions, wherein the circuit pattern includes at least a feeder circuit configured to supply power to the minute loop antenna, and a ground, and the minute loop antenna is mounted on the
(Continued)

circuit board such that: the conductor having the two end portions is connected at one end thereof to the feeder circuit and connected at another end thereof to the ground; a loop surface of the conductor having the two end portions is perpendicular to a plane on which the circuit pattern is formed; and a normal line passing through the loop surface does not pass through the circuit pattern.

23 Claims, 20 Drawing Sheets

(51) Int. Cl.

| | |
|---|---|
| ***H01Q 1/38*** | (2006.01) |
| ***H01Q 1/42*** | (2006.01) |
| ***H01Q 1/48*** | (2006.01) |
| ***H01Q 7/00*** | (2006.01) |
| *G07C 9/00* | (2006.01) |

(52) U.S. Cl.
CPC ..... *H01Q 1/48* (2013.01); *H01Q 7/00* (2013.01); *H01Q 7/005* (2013.01); *G07C 2009/00753* (2013.01)

(56) References Cited

U.S. PATENT DOCUMENTS

| | | | | |
|---|---|---|---|---|
| 6,024,585 | A | 2/2000 | Mickievicz et al. | |
| 6,215,456 | B1 * | 4/2001 | Nakanishi | H01Q 1/22 343/702 |
| 6,262,693 | B1 * | 7/2001 | Sutter | H01Q 1/242 343/702 |
| 6,271,796 | B1 | 8/2001 | Itoh et al. | |
| 2002/0018021 | A1 * | 2/2002 | Koyanagi | H01Q 1/243 343/702 |
| 2003/0114118 | A1 | 6/2003 | Fukushima et al. | |
| 2004/0008141 | A1 | 1/2004 | Sato et al. | |
| 2006/0114159 | A1 * | 6/2006 | Yoshikawa | H01Q 1/24 343/702 |
| 2008/0143631 | A1 * | 6/2008 | Autti | H01Q 1/243 343/845 |
| 2009/0315792 | A1 * | 12/2009 | Miyashita | H01Q 1/243 343/742 |
| 2011/0043432 | A1 * | 2/2011 | Ineichen | H01Q 1/38 343/876 |

FOREIGN PATENT DOCUMENTS

| | | | |
|---|---|---|---|
| JP | 08-130403 | A | 5/1996 |
| JP | 11-004112 | A | 1/1999 |
| JP | 11-136020 | A | 5/1999 |
| JP | 11-163612 | A | 6/1999 |
| JP | 2000-332626 | A | 11/2000 |
| JP | 2002-204114 | A | 7/2002 |
| JP | 2004-023624 | A | 1/2004 |
| JP | 2006-157206 | A | 6/2006 |
| JP | 2008-288930 | A | 11/2008 |
| JP | 2008-301112 | | 12/2008 |
| WO | 92/020117 | A1 | 11/1992 |

OTHER PUBLICATIONS

International Search Report for PCT/JP2014/004060 dated Nov. 4, 2014 [PCT/ISA/210].
Written Opinion for PCT/JP2014/004060 dated Nov. 4, 2014 [PCT/ISA/237].

* cited by examiner

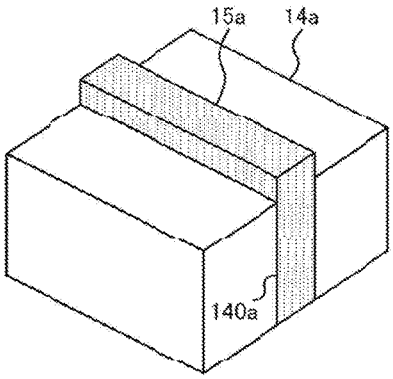
FIG. 26A SIDE SURFACE GROOVE
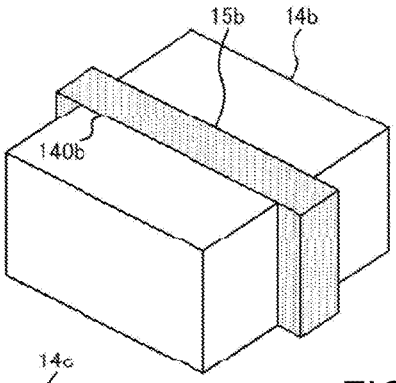
UPPER SURFACE GROOVE FIG. 26B
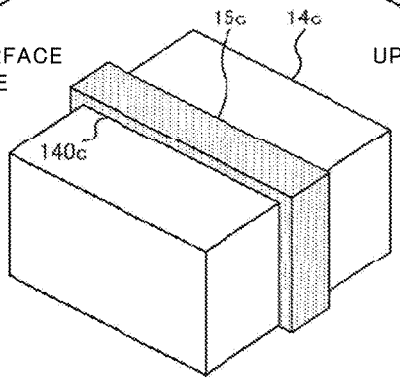
FIG. 26C UPPER SURFACE/ SIDE SURFACE GROOVES

ANTENNA DEVICE AND ANTENNA MANUFACTURING METHOD

CROSS REFERENCE TO RELATED APPLICATIONS

This application is a National Stage of International Application No. PCT/JP2014/004060 filed Aug. 4, 2014, claiming priority based on Japanese Patent Application No. PCT/JP2014/002192 filed Apr. 17, 2014, the contents of all of which are incorporated herein by reference in their entirety.

TECHNICAL FIELD

The present invention relates to an antenna device mounted in a remote keyless entry system and a manufacturing method for the antenna device.

BACKGROUND ART

Hitherto, a remote keyless entry system has been developed which performs wireless communication via radio waves between a vehicle and a portable apparatus carried by a user of the vehicle to allow the doors of the vehicle to be locked or unlocked.

The remote keyless entry system includes: the portable apparatus that emits radio waves for instructing locking or unlocking of the doors by an operation of the user; and an on-vehicle apparatus that locks or unlocks the doors on the basis of the radio waves emitted from the portable apparatus.

In the remote keyless entry system which performs typical unidirectional communication, the on-vehicle apparatus is provided with an antenna device that receives the radio waves from the portable apparatus, and the portable apparatus is provided with an antenna device that emits radio waves for instructing locking or unlocking of the doors.

The antenna device of the portable apparatus is provided with a minute loop antenna obtained by forming a conductor into a loop shape. The antenna device of the portable apparatus supplies power to the minute loop antenna when emitting radio waves. It is known that at this time, an electric current flows through not only the minute loop antenna but also a circuit board on which the minute loop antenna is provided, so that radio waves are emitted also from the flowing electric current. That is, in the antenna device, radio waves are emitted also from the entire antenna device including the circuit board, in addition to the minute loop antenna which is intentionally provided by a designer. Thus, there is a problem that antenna performance cannot be obtained as intended by the designer.

Therefore, a technique has been developed in which the structure of the minute loop antenna is symmetrized as seen from a feeding point, thereby reducing the electric current flowing through the circuit board (e.g., Patent Document 1).

CITATION LIST

Patent Document

Patent Document 1: Japanese Laid-Open Patent Publication No. 2008-288930

SUMMARY OF THE INVENTION

Problems to be Solved by the Invention

The antenna device disclosed in Patent Document 1 includes a minute loop antenna such that a loop surface formed by the minute loop antenna is perpendicular to a circuit board and a normal line passing through the loop surface passes through the surface of a conductor on the circuit board. That is, in the antenna device disclosed in Patent Document 1, magnetic charge (hereinafter, flow of the magnetic charge is defined as magnetic current) flowing in the direction of the normal line passing through the minute loop antenna passes through the surface of the conductor on the circuit board. When the magnetic current passes through the surface of the conductor, an electric field generated by the magnetic current can be regarded ideally as 0 at the surface of a perfect conductor, and thus the magnetic current is hard to flow therethrough (magnetic current M=normal vector N on conductor surface×electric field E ("×" represents an exterior product)). Therefore, there is a problem that the electric current supplied to the minute loop antenna also decreases.

The present invention has been made in view of the above problems, and an object of the present invention is to reduce loss of an electric current supplied to a minute loop antenna.

Solution to the Problems

An antenna device according to the present invention is a circuit board; a circuit pattern formed by a conductor on a surface of the circuit board; and a small loop antenna mounted on the circuit board and formed in a loop shape by a conductor having two end portions, wherein the circuit pattern includes at least a feeder circuit configured to supply power to the small loop antenna, and a ground, and the small loop antenna is mounted on the circuit board such that: the conductor having the two end portions is connected at one end thereof to the feeder circuit and connected at another end thereof to the ground; a loop surface of the conductor having the two end portions is perpendicular to a plane on which the circuit pattern is formed; and a normal line passing through the loop surface does not pass through the circuit pattern.

An antenna manufacturing method according to the present invention is a manufacturing method for an antenna device including a minute loop antenna configured to emit a radio wave when power is supplied thereto, the manufacturing method including: a step of forming, on a circuit board, a circuit pattern including a feeder circuit configured to supply the power to the minute loop antenna, and a ground; and a connection step of connecting one end of a first conductor which is bent beforehand to the feeder circuit, connecting another end of the first conductor to a second conductor which is bent beforehand, and connecting an end of the second conductor which end is opposite to an end connected to the first conductor, to the ground on the circuit board, to form the minute loop antenna, wherein the connection step includes connecting the first conductor and the second conductor to the circuit board such that: a loop surface formed by the first conductor and the second conductor is perpendicular to a plane on which the circuit pattern is formed; and a normal line passing through the loop surface does not pass through the circuit pattern.

Effect of the Invention

In the present invention, since the minute loop antenna is mounted on the circuit board such that: the loop surface is perpendicular to the plane on which the circuit pattern is formed; and the normal line passing though the loop surface does not pass through the circuit pattern, a magnetic current is not hindered by the circuit pattern, and loss of the power supplied to the minute loop antenna can be reduced.

BRIEF DESCRIPTION OF THE DRAWINGS

FIGS. 26A, 26B and 26C shows modifications in which the minute loop antenna 1 is formed by the resinous component 14 and the conductor 15 in the antenna device according to Embodiment 10.

DESCRIPTION OF EMBODIMENTS

Embodiment 1

Figure 1:
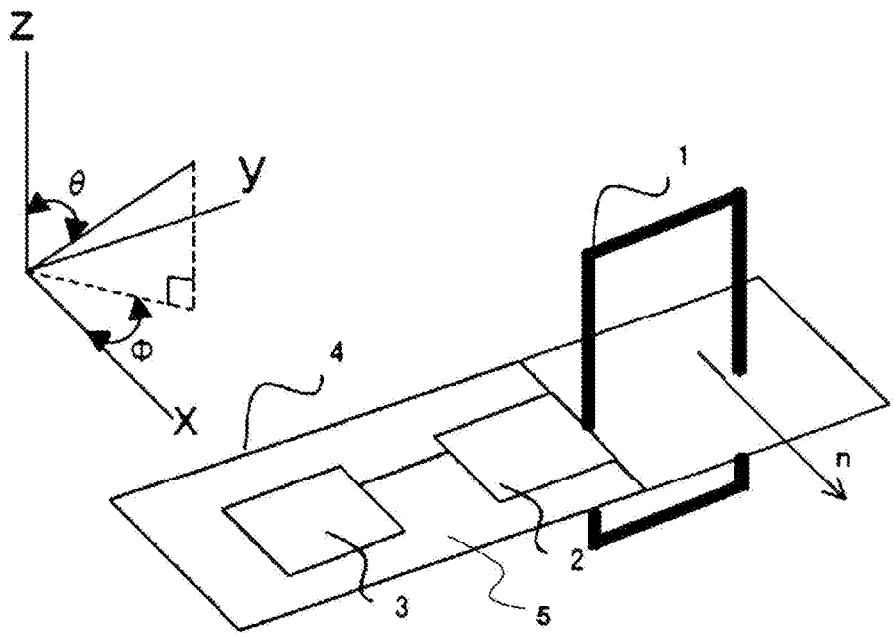
FIG. 1 is a perspective view of an antenna device according to Embodiment 1.

Hereinafter, an antenna device according to Embodiment 1 will be described with reference to FIGS. 1 to 9. FIG. 1 is a perspective view of the antenna device according to Embodiment 1. In FIG. 1, the antenna device includes a minute loop antenna element 1 (minute loop antenna 1), a transmitting circuit 2 (feeder circuit 2), a switch 3, a circuit board 4, and a ground 5. In the following description, as expression of a spherical coordinate system, the direction of an angle formed with a Z axis is denoted by $\theta$, and the direction of an angle formed with an X axis is denoted by $\phi$.

When power is supplied to the minute loop antenna 1, the minute loop antenna 1 emits radio waves. The minute loop antenna 1 is a conductor formed in a loop shape and has two terminals (hereinafter, referred to as end portions). The shape of the minute loop antenna 1 according to the present embodiment is a quadrangular shape as shown in FIG. 1, but is not limited thereto, and may not be a symmetrical shape or may be composed of a curved line as long as the minute loop antenna 1 functions. In addition, a loop surface formed by the minute loop antenna 1 may not be a perfect flat surface. The loop surface is a surface formed by a conductor of the minute loop antenna 1, in a region to a feeding point at which the minute loop antenna 1 is connected to the feeder circuit 2 described later and a ground point at which the minute loop antenna 1 is connected to the ground 5 described later. Furthermore, the conductor of the minute loop antenna 1 is produced by sheet metal working, but is not limited thereto, and may be produced with a wire-like conductor rod such as a tinned wire. By producing the minute loop antenna 1 with a conductor rod such as a tinned wire as described above, the minute loop antenna 1 can be produced at lower cost than by sheet metal working. In general, the minute loop antenna 1 is composed of a conductor having a loop length that is very short as compared to the wavelength of radio waves to be emitted, and a conductor having a length that is equal to or less than 1/10 of the wavelength of the radio waves to be emitted is preferably used.

The feeder circuit 2 is a circuit that generates a high-frequency signal, and the high-frequency signal generated by the feeder circuit 2 is caused to flow as an electric current through the minute loop antenna 1.

The switch 3 is a switch that controls the feeder circuit 2 by an operation of a user, and is connected to the feeder circuit 2 via a control circuit (not shown) or the like. The user causes the electric current to flow from the feeder circuit 2 through the minute loop antenna 1 by operating the switch 3, to emit radio waves from the minute loop antenna 1 to a receiving antenna provided in an on-vehicle apparatus.

The minute loop antenna 1 is mounted on the circuit board 4. In addition, the circuit board 4 has a circuit pattern, and the feeder circuit 2, the switch 3, and the ground 5 are formed as the circuit pattern. The ground 5 is formed also on a back surface of the circuit board 4. The shape of the circuit board 4 is a plate-like rectangle. The shape of the circuit board 4 is not limited to the rectangle and may be an elliptical shape, a square shape, or the like. However, from the standpoint of easiness of operation of a portable apparatus by the user, the circuit board 4 preferably has a shape that is long in one direction and short in one direction.

Figure 2:
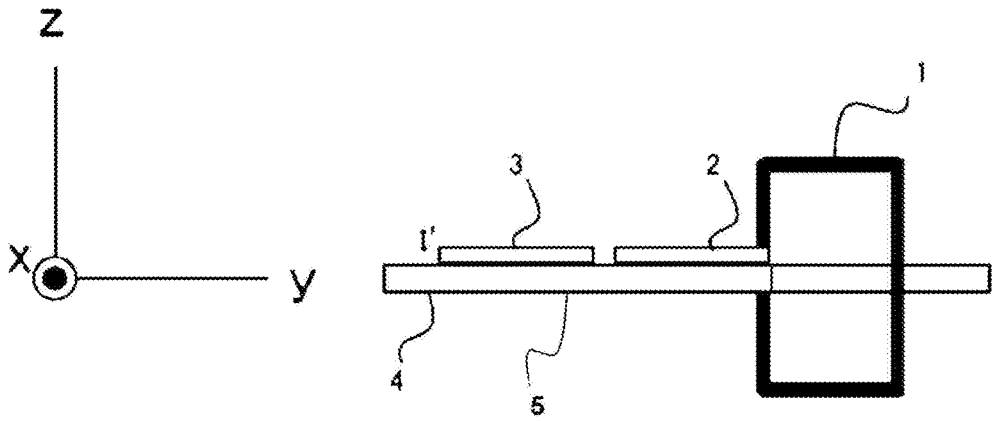
FIG. 2 is a side view of the antenna device according to Embodiment 1.

Here, the positional relationship among the minute loop antenna 1, the feeder circuit 2, the switch 3, the circuit board 4, and the ground 5 will be described in detail. FIG. 2 is a side view of the antenna device according to Embodiment 1. As shown in FIG. 2, the loop surface of the minute loop antenna 1 is located on a plane parallel to a YZ plane. The feeder circuit 2, the switch 3, the circuit board 4, and the ground 5 are located on an XY plane. The minute loop antenna 1 is connected at one end thereof to the feeder circuit 2, and is connected at another end thereof to the ground 5 from the back surface of the circuit board 4. In this case, as shown in FIG. 1, the minute loop antenna 1 is arranged such that a normal vector n passing through the loop surface formed by the minute loop antenna 1 is parallel to the X axis. That is, the minute loop antenna 1 is mounted on the circuit board 4 such that: the loop surface of the conductor having two end portions is perpendicular to a plane on which the circuit pattern is formed; and a normal line passing through the loop surface does not pass through the circuit pattern. In FIG. 2, the minute loop antenna 1 is shown such that the end portions thereof are present on different surfaces at the back and the front of the circuit board 4. However, the end portions may be present on the same surface as long as one end of the minute loop antenna 1 is connected to the feeder circuit 2 and the other end of the minute loop antenna 1 is connected to the ground 5 on the circuit board 4. In addition, it is not essential that the ground 5 is formed on both surfaces of the circuit board 4. Furthermore, the minute loop antenna 1 only needs to be mounted on the circuit board 4 such that the loop surface thereof does not face in the direction to the circuit pattern in which conductors such as the feeder circuit 2, the switch 3, and the ground 5 are gathered, that is, the loop surface thereof is parallel to the YZ plane, and a part of the circuit pattern or another minute conductor pattern may be formed in a region of the normal vector n passing through the above loop surface.

Figure 3:
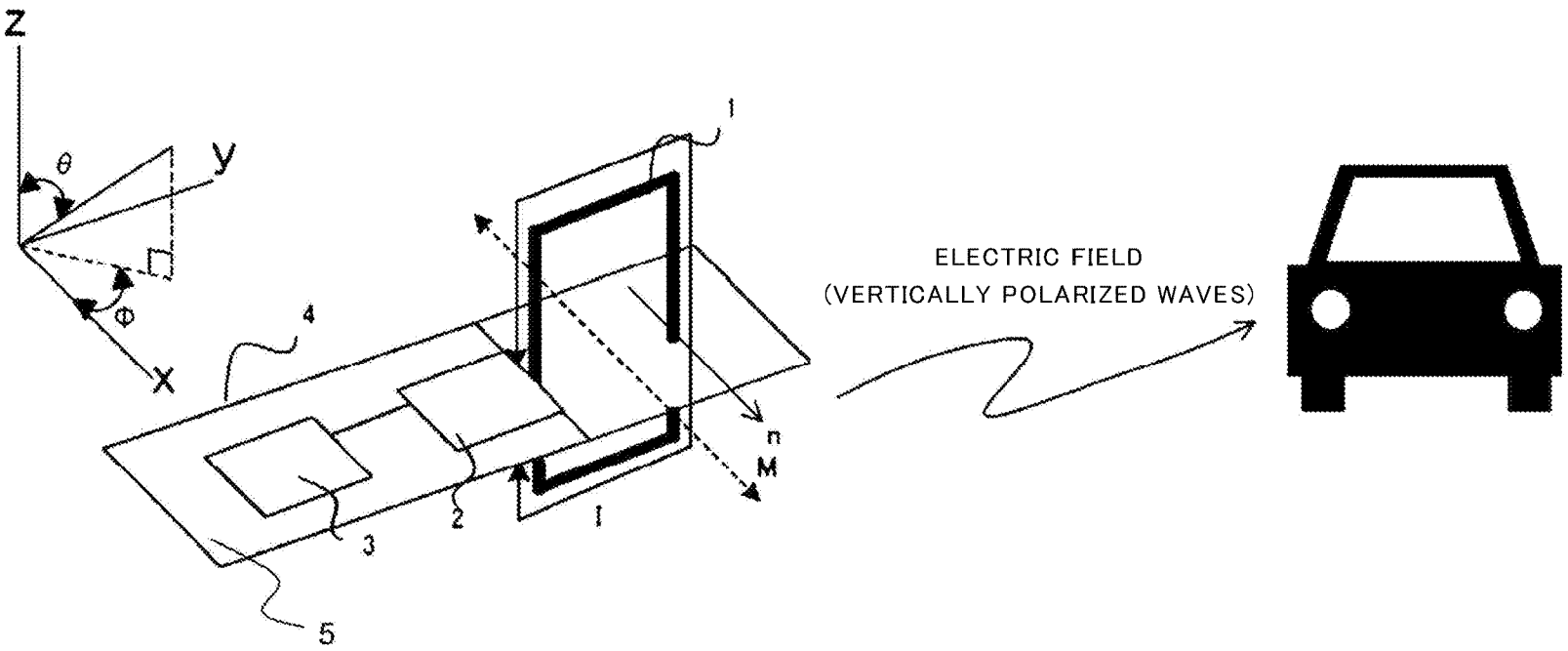
FIG. 3 is a diagram illustrating operation of the antenna device according to Embodiment 1, and is a perspective view.
Figure 4:
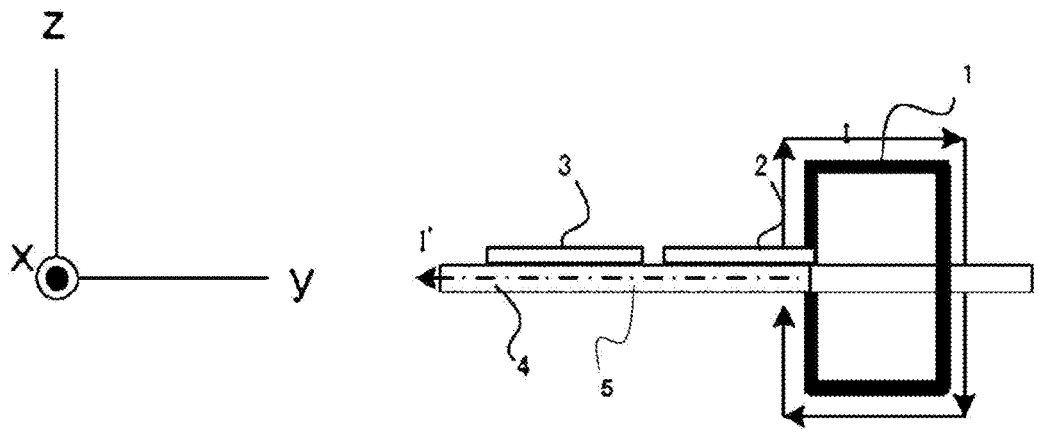
FIG. 4 is a diagram illustrating operation of the antenna device according to Embodiment 1, and is a side view.

Hereinafter, operation of the antenna device according to Embodiment 1 will be described with reference to FIGS. 3 and 4. FIG. 3 is a diagram illustrating operation of the antenna device according to Embodiment 1, and is a perspective view. FIG. 4 is a diagram illustrating operation of the antenna device according to Embodiment 1, and is a side view.

The switch 3 outputs a signal to the feeder circuit 2 in accordance with an operation of the user. The feeder circuit 2 generates a high-frequency signal on the basis of the signal from the switch 3. The high-frequency signal generated by the feeder circuit 2 flows as an electric current through the minute loop antenna 1. At this time, the electric current flowing through the minute loop antenna 1 is defined as minute loop mode electric current I. The minute loop antenna 1 emits radio waves (vertically polarized waves) by the minute loop mode electric current I. When flow of magnetic charge flowing parallel to the normal vector n passing through the loop surface formed by the minute loop antenna 1 is assumed as a magnetic current M, the emitted radio waves can be also considered being emitted from the magnetic current M. In the antenna device according to the present embodiment, the circuit pattern, which is a conductor, is not present in a space in which the magnetic current M flows, and thus the magnetic current M is not hindered from flowing therein. Therefore, the minute loop mode electric current I is also not hindered from flowing through the minute loop antenna 1. In general, it is known that when power is supplied to a small-size antenna mounted in a portable apparatus of a remote keyless entry system, an electric current flows through a conductor present around the antenna in addition to the antenna itself, so that radio waves are emitted also from this electric current. Also in the antenna device according to the present embodiment, when the minute loop mode electric current I flows through the minute loop antenna 1, an electric current I' (hereinafter, referred to as dipole mode electric current I') flows through the conductor around the minute loop antenna 1, that is, a conductor portion of the circuit board 4, as shown in FIG. 4. The total amount of power supplied by the feeder circuit 2 is predetermined. Thus, as the dipole mode electric current I' increases more and more, the minute loop mode electric current I decreases, so that the emission from the minute loop antenna 1 reduces. In the antenna device according to the present embodiment, since the circuit pattern, which is a conductor, is not present in the space in which the magnetic current M flows, the minute loop mode electric current I flowing through the minute loop antenna 1 is not hindered. That is, the dipole mode electric current I' can be reduced. The radio waves emitted from the minute loop antenna 1 are received by an antenna device at the on-vehicle apparatus side and control a vehicle. For example, locking and unlocking of doors can be controlled on the basis of the emitted radio waves.

Figure 5:
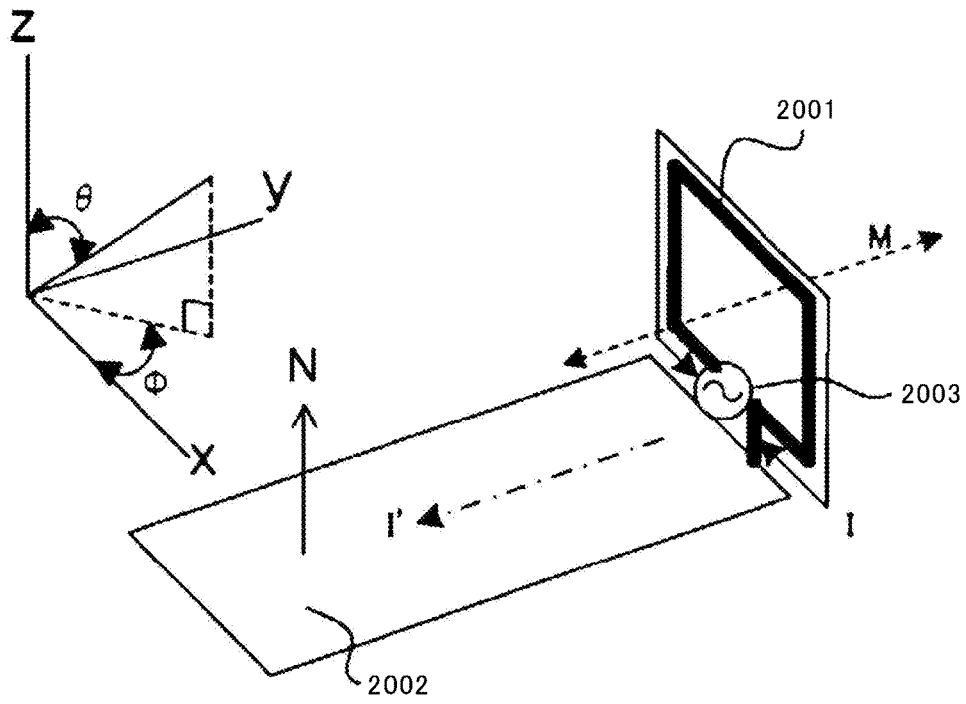
FIG. 5 is a perspective view of a conventional antenna device.

Hereinafter, effects of the antenna device according to the present embodiment will be described in detail with reference to FIG. 5. FIG. 5 is a perspective view of a conventional antenna device. In the conventional antenna device shown in FIG. 5, a minute loop antenna 2001 is arranged on the ZX plane, and a circuit board 2002 is arranged on the XY plane. The minute loop antenna 2001 is connected at one end thereof to the ground on the circuit board 2002 and connected at another end thereof to a feeding point 2003 on the circuit board 2002. That is, in this example, the minute loop antenna 2001 is arranged such that a normal line passing through the loop surface thereof passes on a circuit pattern on the circuit board 2002. Since the minute loop antenna 2001 is formed on the ZX plane, the magnetic current M is parallel to a Y axis. Emission by the minute loop mode electric current I flowing through the minute loop antenna 2001 is null in the Y axis direction, and exhibits a pattern that is isotropic on the ZX plane. On the XY plane, the polarized waves of an electric field are vertically polarized waves. The electric current I' is an electric current flowing on the circuit board 2002.

Here, the reason why the dipole mode electric current I' becomes high in the conventional antenna device shown in FIG. 5 will be described in detail. When the magnetic current M flows on the circuit board as a general phenomenon of an electromagnetic field, the following relational expression (formula 1) is established.

$$M=E\times N \qquad \text{(Formula 1)}$$

Here, an electric field on the surface of the circuit board is E, a magnetic current is M, and a normal vector of the circuit board 2002 is N. The normal vector N has a starting point on the circuit board 2002 and indicates a positive direction along the Z axis. The operator X represents an exterior product of the vector. In the example of the antenna device in FIG. 5, the magnetic current M is generated in the normal direction of the loop surface of the minute loop antenna 2001. Therefore, the magnetic current M is generated on the surface of the circuit pattern on the circuit board 2002. In general, the electric field E is 0 on the surface of a perfect conductor. Therefore, the magnetic current $M=0\times N=0$, so that it can be said that the magnetic current M is hard to flow in the antenna device in FIG. 5. That is, according to the law of electromagnetic field, it is found that the minute loop mode electric current I is hard to flow through the minute loop antenna 2001. The circuit pattern is actually not a perfect conductor, but it is found that the magnetic current M shown in FIG. 5 becomes significantly low as compared to the magnetic current M in the antenna device according to the present embodiment. Since the total amount of power supplied by the feeder circuit 2 is predetermined, as the minute loop mode electric current I is harder to flow, the dipole mode electric current I' becomes higher. That is, it can be said that as the dipole mode electric current I' increases more and more, the minute loop mode electric current I decreases, so that emission from the minute loop antenna 2001 is weakened.

As described above, in the antenna device in FIG. 5, the intensity of radio waves emitted to the vehicle decreases. Furthermore, since the minute loop mode electric current I is hard to flow, the dipole mode electric current I' flowing on the circuit board 2002 is a main electric current, so that an electric current flowing through an arm of the user holding a portable apparatus equipped with the antenna device becomes high. In a scene in which the remote keyless entry system is used, the user holds the portable apparatus, directs their hand holding the portable apparatus toward the vehicle, and operates a button of the portable apparatus with their finger to instruct locking or unlocking of the doors. At this time, the arm is directed toward the vehicle, and thus serves as a dipole antenna, and radio waves that are not intended by a designer are emitted from the arm of the user. The radio waves emitted from the arm variously change depending on the body type, the constitution, the attitude, or the like of the user. Thus, a problem arises that the transmission performance of the portable apparatus is not stabilized.

Meanwhile, in the antenna device according to the present embodiment, the minute loop antenna 1 is mounted on the circuit board 4 such that: the loop surface of the conductor having two end portions is perpendicular to the plane on which the circuit pattern is formed; and the normal line passing through the loop surface does not pass through the circuit pattern. Therefore, the magnetic current M in the minute loop antenna 1 is not hindered by the circuit pattern, and thus radio waves can be more strongly emitted in the direction toward the vehicle. In addition, according to the antenna device, an electric current flowing through the arm of the user can be reduced, so that the transmission performance of the portable apparatus can be stabilized.

In addition, there is a characteristic that vertically polarized waves are well reflected on the trunk of the user, and horizontally polarized waves are hard to be reflected on the trunk of the user. In the antenna device according to the present embodiment, the minute loop antenna 1 emits radio waves as vertically polarized waves in the direction toward the vehicle (the Y axis direction) and the direction toward the trunk of the user (−Y direction). Therefore, an electric field emitted from the minute loop antenna 1 toward the trunk of the user is reflected on the trunk of the user and emitted in the front direction of the trunk of the user, that is, in the direction toward the vehicle. Thus, radio waves from the portable apparatus toward the vehicle are intensified, so that there is also an effect that the working distance of the remote keyless system is extended.

Figure 6:
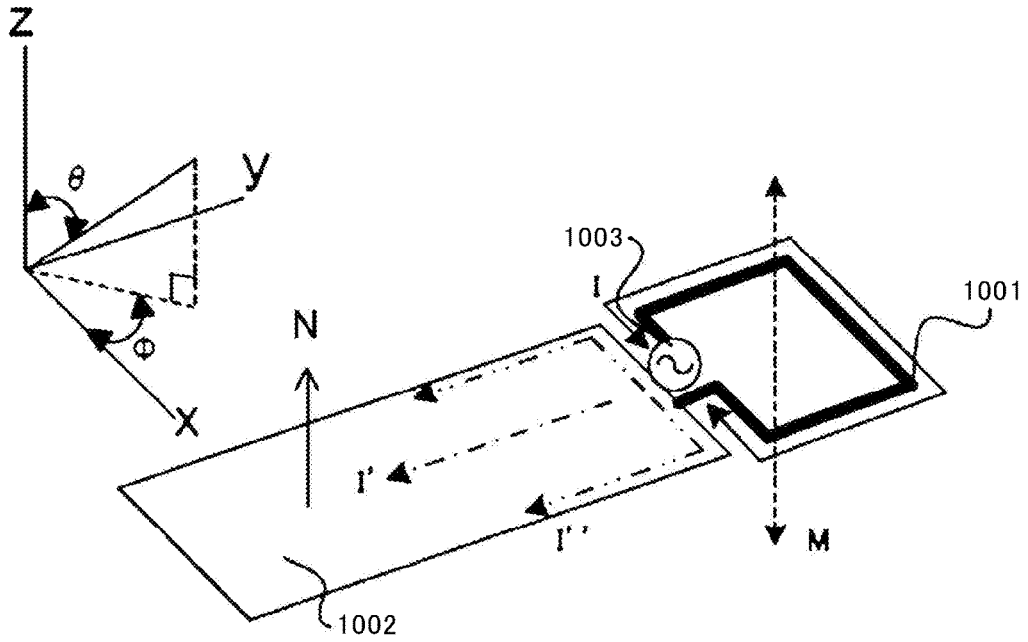
FIG. 6 is a perspective view of a conventional antenna device and is an example in which the loop surface of a minute loop antenna is present on a plane on a circuit board.

Furthermore, the antenna device according to the present embodiment includes the minute loop antenna 1 such that the loop surface of the minute loop antenna 1 is perpendicular to the plane on the circuit board 4. The effect thereof will be described in detail with reference to FIG. 6. FIG. 6 is a perspective view of a conventional antenna device and is an example in which the loop surface of a minute loop antenna is present on a plane on a circuit board. For example, in the antenna device shown in FIG. 6, a minute loop antenna 1001 is mounted such that a circuit board 1002 and the loop surface are present on the same plane. In addition, the minute loop antenna 1001 is connected at one end thereof to a ground (not shown) on the circuit board 1002 and connected at another end thereof to a feeding point 1003 on the circuit board 1002. The minute loop antenna 1001 is formed on the XY plane, and thus the magnetic current M flows in a direction parallel to the Z axis. Therefore, emission by the minute loop mode electric current I flowing through the minute loop antenna 1001 is null in the Z axis direction, and exhibits a pattern that is isotropic on the XY plane. The polarized waves of an electric field are horizontally polarized waves. In the case of this example as well, the dipole mode electric current I' is generated on the circuit board 1002. Meanwhile, it is known that when an electric current flows near a conductor, an image electric current I" flows within the conductor. The image electric current I" is an electric current having the same amplitude as that of the electric current I and having a direction opposite to that of the electric current I. In FIG. 6, the circuit board 1002 is present so as to oppose a path through which the minute loop mode electric current I in the minute loop antenna 1001 flows, and thus the image electric current I" flows through the circuit board 1002. As described above, in the antenna device in FIG. 6, the dipole mode electric current I' and the image electric current I" flow through the circuit board 1002. Therefore, the minute loop mode electric current I flowing through the minute loop antenna 1001 decreases. In addition, the electric current flowing through the arm of the user holding the portable apparatus equipped with the antenna device also increases. The radio waves emitted by the electric current flowing through the arm are emitted from the arm in the upward, downward, rightward, and leftward directions of the user, and are not emitted in the longitudinal direction of the arm. That is, in a situation in which the portable apparatus of the remote keyless entry system is directed toward the vehicle and operated, emission is not performed in the direction toward the vehicle (Y axis direction). The radio waves emitted in the direction toward the vehicle are only radio waves emitted by the minute loop mode electric current I. Since the amount of power that can be supplied by the feeding point 1003 is predetermined, the intensity of the radio waves emitted from the minute loop antenna 1001 in the direction toward the vehicle is decreased due to the emission from the arm of the user in the upward, downward, rightward, and leftward directions of the user. Therefore, in the portable apparatus using the antenna device in FIG. 6, the working distance of remote keyless operation is shortened. In addition, all electric fields emitted from the antenna device in FIG. 6 are horizontally polarized waves. Thus, the influence of reflection on the trunk of the user is small, so that an effect cannot be expected that the radio waves emitted toward the user are reflected on the body of the user to intensify the radio waves emitted in the direction toward the vehicle.

As described above, in the antenna device according to Embodiment 1, since the minute loop antenna 1 is mounted on the circuit board 4 such that: the loop surface is perpendicular to the plane on which the circuit pattern is formed; and the normal line passing through the loop surface does not pass through the circuit pattern, the magnetic current M is not hindered by the circuit pattern, so that loss of the power supplied to the minute loop antenna 1 can be reduced.

In the antenna device according to Embodiment 1, as shown in FIGS. 1 to 4, the minute loop antenna 1 and the switch 3 are preferably arranged at both short-side ends of the circuit board 4. With such a configuration, when the user operates the switch 3, the hand of the user and the minute loop antenna 1 are located on the portable apparatus such that the hand and the minute loop antenna 1 are away from each other by a maximum distance. Therefore, even when the dipole mode electric current I' is generated to some extent, the electric current flowing through the arm of the user is reduced as compared to the case where the minute loop antenna 1 and the switch 3 are located close to each other. Thus, emission from the arm of the user is reduced, and fluctuations of the transmission performance of the portable apparatus due to the body type, the constitution, the attitude, or the like of the user are reduced.

Figure 7:
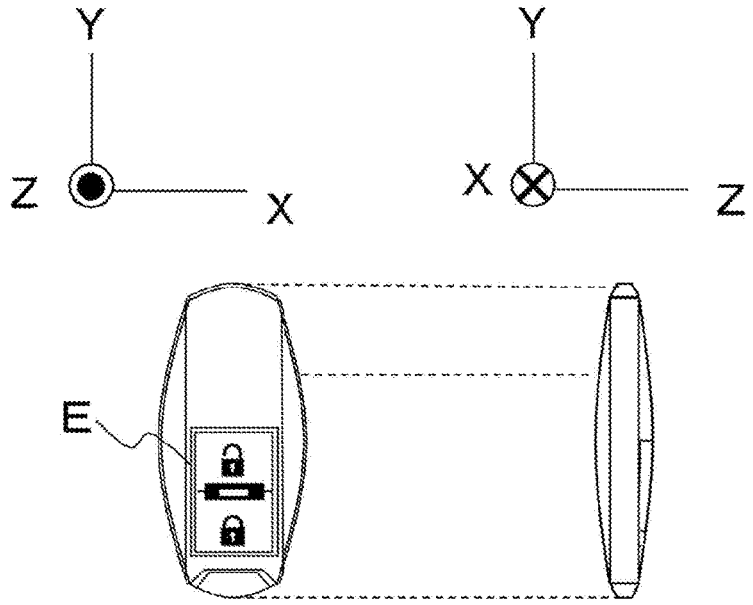
FIG. 7 is an example of a casing of a portable apparatus in which the antenna device according to Embodiment 1 is mounted.
Figure 8A:
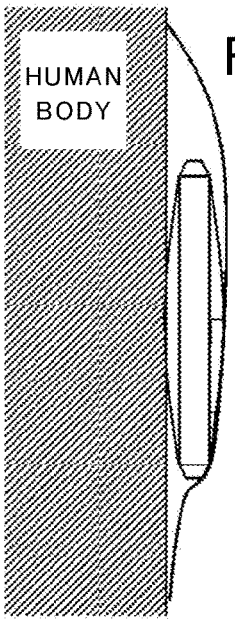
FIGS. 8A and 8B are examples in which the antenna device according to Embodiment 1 is housed.
Figure 8B:
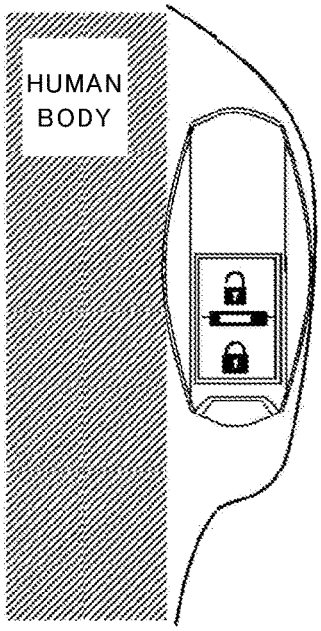

Regarding a casing of the portable apparatus equipped with the antenna device according to the present embodiment, the shape of the casing is preferably devised such that a surface of the casing which surface touches a human body is not on the YZ plane. FIG. 7 is an example of the casing of the portable apparatus in which the antenna device according to Embodiment 1 is mounted. FIGS. 8A and 8B are examples in which the antenna device according to Embodiment 1 is housed. For example, as shown in FIG. 7, the casing of the antenna device according to Embodiment 1 is preferably formed such that the area of the portable apparatus as seen from the Z axis direction is larger than the area of the portable apparatus as seen from the X axis direction. In the antenna device according to the present embodiment, since the magnetic current M flows in the X axis direction, even when a conductor approaches from the Y axis direction and the Z axis direction, the flow of the magnetic current M is not hindered. That is, the radio waves emitted from the minute loop antenna 1 are hard to be influenced by the approach of the conductor from the Y axis direction and the Z axis direction. When the casing shown in FIG. 7 is used, even in the case where the portable apparatus is housed in a pocket or the like as shown in FIG. 8A, the surface touching a human body is not present on the YZ plane. That is, in the case where the casing of the portable apparatus is formed such that the area of the casing as seen from the Z axis direction is large, there is a low possibility that the portable apparatus is housed as shown in FIG. 8B. Therefore, the human body is prevented from being located in the normal direction of the loop surface, and deterioration of the antenna performance can be reduced even when the portable apparatus is in close contact with the human body. In addition, in the case where a metallic component is mounted to the casing of the portable apparatus, it is preferable if the metallic component is mounted at a position shifted slightly in the +Z direction from the minute loop antenna 1 (at a position E in FIG. 7). Deterioration of the antenna performance due to the metallic component being mounted at this position is slight.

Figure 9:
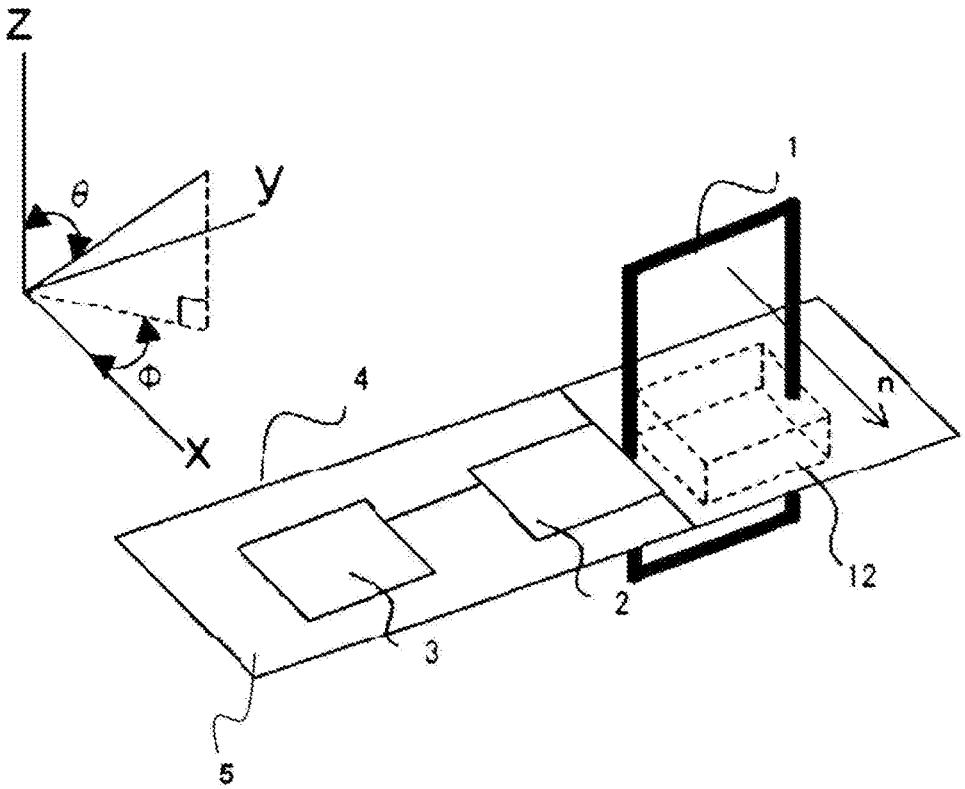
FIG. 9 is an example in which an LF communication coil is provided in the antenna device according to Embodiment 1.

FIG. 9 is an example in which an LF communication coil 12 is provided in the antenna device according to Embodiment 1. The LF communication coil 12 performs wireless communication within an area in which a magnetic field generated from an LF communication antenna (not shown) of the on-vehicle apparatus is detected. That is, the on-vehicle apparatus is able to determine whether the user carrying the portable apparatus including the LF communication coil 12 is inside the vehicle or outside the vehicle. Therefore, the on-vehicle apparatus is able to perform control such as opening a door when the user carrying the portable apparatus equipped with the antenna device comes close to the vehicle. Even when the minute LF communication coil 12 is provided in the direction of the magnetic current M in the minute loop antenna 1, operation of the antenna is not greatly hindered. As described above, in the antenna device according to the present embodiment, it is preferable if the region in which the circuit pattern of the switch 3, the feeder circuit 2, and the like gathers is not located in the direction of the magnetic current in the minute loop antenna 1, and the antenna device can include a minute component such as the LF communication coil 12.

In the antenna device according to the present embodiment, the circuit board 4 is present within the loop surface formed by the minute loop antenna 1. However, the essence of the antenna device according to the present embodiment is that no conductor is present in the space in which the magnetic current M flows. Thus, even when the circuit board 4, which is a nonconductor, is present within the loop, the circuit board 4 does not influence the minute loop mode electric current I. In addition, even in the case where the antenna device is configured such that the feeder circuit 2 is provided at the edge of the circuit board 4 and the circuit board 4 is not arranged within the loop surface formed by the minute loop antenna 1, the same effects are obtained.

Embodiment 2

Hereinafter, an antenna device according to Embodiment 2 will be described. The antenna device according to Embodiment 2 is characterized in that the shape of the minute loop antenna 1 is symmetrized.

The minute loop antenna 1 according to the present embodiment is characterized in that the shape of the minute loop antenna 1 above the plane (XY plane) of the circuit board 4 and the shape of the minute loop antenna 1 below the plane (XY plane) of the circuit board 4 are symmetrical to each other.

In general, it is well known that when the shape of the minute loop antenna 1 (including the ground 5) is symmetrized based on the feeding point of the minute loop antenna 1 mounted on the circuit board 4, the proportion of the dipole mode electric current I' in all electric currents supplied from the feeding point becomes low. That is, in the case of the antenna device shown in Embodiment 1, by making the structure of the minute loop antenna 1 symmetrical with respect to the circuit board 4, the dipole mode electric current I' can be reduced further. Here, the shape includes a length. It is much preferable if the material is the same.

When the dipole mode electric current I' supplied from the feeding point is reduced, the electric current flowing through the arm of the user holding the portable apparatus also decreases. That is, since the radio waves emitted from the arm of the user are reduced, the portable apparatus to which the antenna device according to the present embodiment is applied can ensure stable performance without depending on the body type, the constitution, the attitude, or the like of the user.

Embodiment 3

Hereinafter, an antenna device according to Embodiment 3 will be described with reference to FIG. 10. The antenna device according to Embodiment 3 is characterized in that the minute loop antenna 1 is composed of two conductors. In the description of each component shown in FIG. 10, the components that are the same as those shown in FIGS. 1 to 4 and 9 are designated by the same numerals, and the description thereof is omitted.

Figure 10:
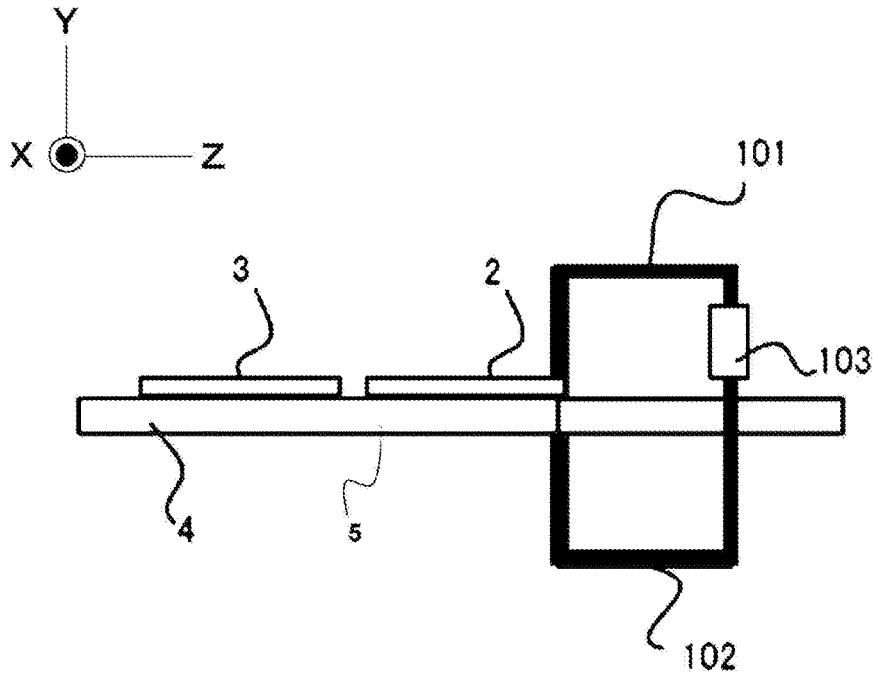
FIG. 10 is a side view of an antenna device according to Embodiment 3.

FIG. 10 is a side view of the antenna device according to Embodiment 3. In FIG. 10, the minute loop antenna 1 includes a first conductor 101, a second conductor 102, and a connection portion 103. The first conductor 101 has a shape obtained by bending a conductor rod, and is electrically connected at one end thereof to the feeder circuit 2 and electrically connected at another end thereof to the connection portion 103. The second conductor 102 has a shape obtained by bending a conductor rod, and is electrically connected at one end thereof to the ground 5 on the circuit board 4 and electrically connected at another end thereof to the connection portion 103. The first conductor 101 and the second conductor 102 are arranged at sides opposite to each other across the circuit board 4. That is, the first conductor 101, the second conductor 102, and the connection portion 103 are all electrically connected, and the minute loop antenna 1 is formed by the first conductor 101, the second conductor 102, and the connection portion 103.

Next, effects of the antenna device according to Embodiment 3 will be described. In the case where the minute loop antenna 1 is formed of a single conductor as shown in FIG. 1, in producing the antenna device, the circuit board 4 is bored, and a conductor that is the material of the minute loop antenna 1 is inserted into the hole. After the conductor is inserted, an operation of bending the conductor is subsequently performed, thereby forming a loop of the minute loop antenna 1. However, it is very difficult to bend the conductor while the conductor of the minute loop antenna 1 is inserted in the hole of the circuit board 4, so that the workability is poor. On the other hand, for the antenna device according to the present embodiment, the first conductor 101 and the second conductor 102 are subjected to bending beforehand, the first conductor 101 or the second conductor 102 is inserted into a hole of the circuit board 4, and further the end portions of the respective conductors are connected to each other by the connection portion 103. As described above, in the antenna device according to the present embodiment, since the minute loop antenna 1 is composed of two conductors, the minute loop antenna 1 can be mounted on the circuit board 4 after the two conductors are subjected to bending. Therefore, the workability improves.

The minute loop antenna 1 according to the present embodiment is composed of two conductors, but only needs to be composed of at least two conductors, and may be formed by connecting a plurality of conductors.

Embodiment 4

Figure 11:
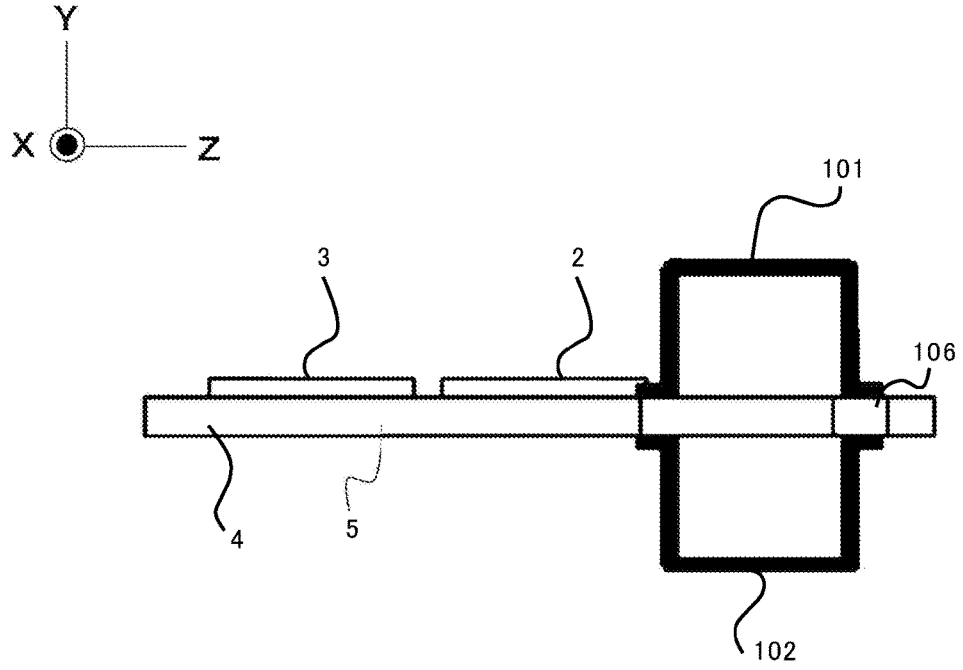
FIG. 11 is a side view of an antenna device according to Embodiment 4.

Hereinafter, an antenna device according to Embodiment 4 will be described with reference to FIG. 11. FIG. 11 is a side view of the antenna device according to Embodiment 4. The antenna device according to Embodiment 4 is characterized in that two conductors are connected by a through hole 106 to form the minute loop antenna 1. In the description of each component shown in FIG. 11, the components that are the same as those shown in FIGS. 1 to 4, 9, and 10 are designated by the same numerals, and the description thereof is omitted.

In FIG. 11, the circuit board 4 is a multilayer circuit board and has the through hole 106 that electrically connects the first conductor 101 and the second conductor 102. The through hole 106 electrically connects the upper surface and the lower surface of the circuit board 4. The through hole 106 is formed by boring the circuit board 4 and plating the inner wall of the hole with a conductor, and electrically connects the upper surface and the lower surface of the circuit board 4. In the present embodiment as well, the first conductor 101 and the second conductor 102 are produced by sheet metal working beforehand, and connected by the through hole 106. In addition, the first conductor 101, the second conductor 102, and the through hole 106 are mounted by SMT (Surface Mount Technology).

According to the antenna device of the present embodiment, since the first conductor 101 and the second conductor 102 are electrically connected by the through hole 106, it is not necessary to insert the conductor into the hole provided in the circuit board 4, leading to shortening of a working process and a working time, so that the cost of the antenna manufacturing process can be reduced.

Embodiment 5

Figure 12:
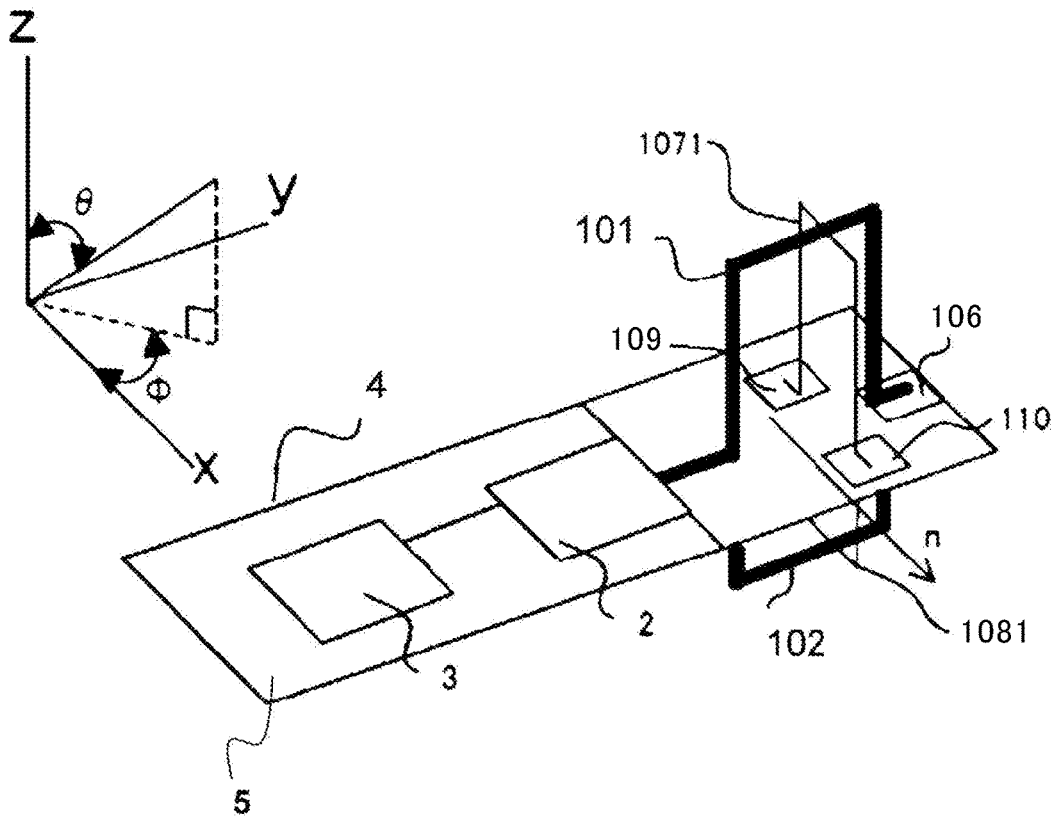
FIG. 12 is a perspective view of an antenna device according to Embodiment 5.

Hereinafter, an antenna device according to Embodiment 5 will be described with reference to FIG. 12. FIG. 12 is a perspective view of the antenna device according to Embodiment 5. In the following description, the components that are the same as those shown in FIGS. 1 to 4 and 9 to 11 are designated by the same numerals, and the description thereof is omitted.

The antenna device according to the present embodiment includes support means (an arm 1071 and an arm 1081) that supports the minute loop antenna 1. Both ends of the arm 1071 are connected to a first pad 109 and a second pad 110, respectively, on the circuit board 4. The first pad 109 and the second pad 110 are not electrically connected to another circuit pattern including the ground 5 on the circuit board 4. Furthermore, the first pad 109 and the second pad 110 are connected to both end portions, respectively of the arm 1081 at the lower surface of the circuit board 4. The arm 1071 and the arm 1081 are in contact with the first conductor 101 and the second conductor 102, respectively, from the circuit board 4 side. That is, the arm 1071 and the arm 1081 support the first conductor 101 and the second conductor 102, respectively, from the circuit board 4 side. In addition, the arm 1071 and the arm 1081 are formed so as to be bent along the ZX plane.

The arms 1071 and 1081 are sufficiently short as compared to the wavelength of a high-frequency signal supplied to the minute loop antenna 1 and have such a thickness that operation of the minute loop antenna 1 is not hindered. In addition, the lengths of the arm 1071 and the arm 1081 are sufficiently short as compared to the wavelength of the high-frequency signal supplied to the minute loop antenna 1, and the widths of the arm 1071 and the arm 1081 are also sufficiently narrow. Thus, the arm 1071 and the arm 1081 do not influence the electrical characteristics of the minute loop antenna 1.

As described above, in the antenna device according to Embodiment 5, since the minute loop antenna 1 is fixed to the circuit board 4 by the first pad 109, the second pad 110, and the arms 1071 and 1081, an effect is obtained that the shape of the minute loop antenna 1 is retained and further the loop surface of the minute loop antenna 1 is fixed such that the loop surface is not moved from a plane parallel to the YZ plane. In addition, by including the arms 1071 and 1081 and connecting parts of the arms 1071 and 1081 to the circuit board 4 as in the antenna device according to the present embodiment, desired strength of the minute loop antenna 1 can be ensured while the electrical characteristics of the minute loop antenna 1 are ensured.

In the description of the antenna device according to the present embodiment, each of the first conductor 101 and the second conductor 102 is connected to the circuit board 4 at four points by the arm 1071 or the arm 1081. However, the number of the connection points with the circuit board 4 is not limited to four, and the same effects are obtained even when each of the first conductor 101 and the second conductor 102 is connected to the circuit board 4 at more connection points.

Embodiment 6

Hereinafter, an antenna device according to Embodiment 6 will be described with reference to FIGS. 13 to 17. The antenna device according to Embodiment 6 is characterized in that at least one of the first conductor 101 and the second conductor 102 is a conductor pattern formed on the circuit board 4. In the following description, the components that are the same as those shown in FIGS. 1 to 4 and 9 to 12 are designated by the same numerals, and the description thereof is omitted.

Figure 13:
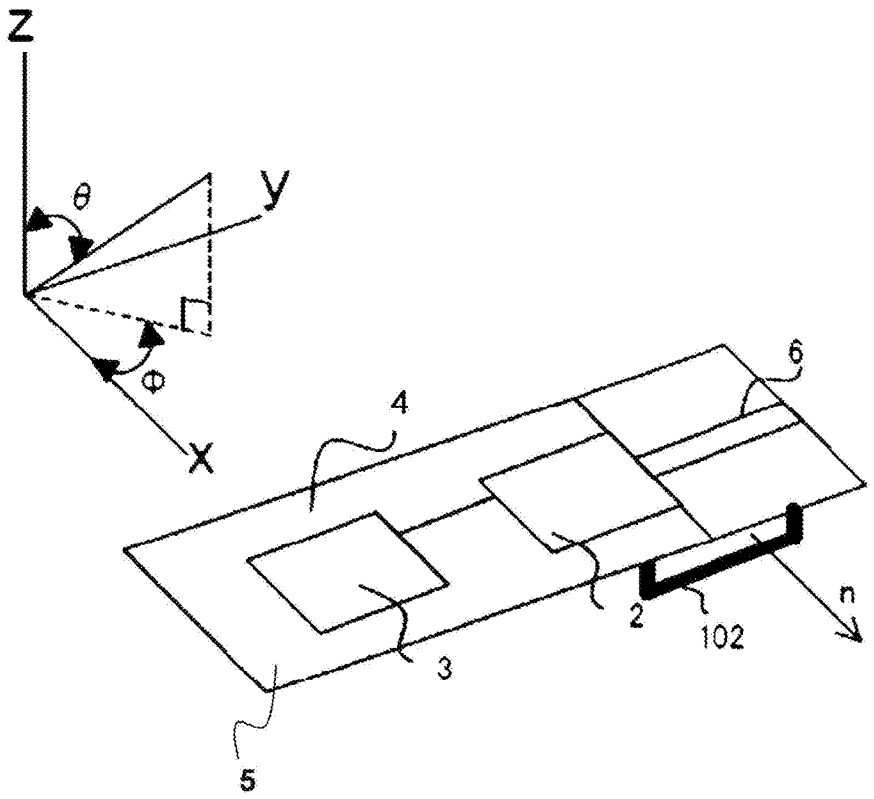
FIG. 13 is a perspective view of an antenna device according to Embodiment 6 and is an example in which a conductor pattern is formed on the upper surface of a circuit board.

FIG. 13 is a perspective view of the antenna device according to Embodiment 6 and is an example in which a first conductor pattern 6 is formed on the upper surface of the circuit board 4. In the antenna device according to the present embodiment, the first conductor 101 shown in FIG. 10 or 11 is eliminated, the first conductor pattern 6 is provided on the upper surface of the circuit board 4 instead, and the first conductor pattern 6 and the second conductor 102 are electrically connected to each other. The minute loop antenna 1 is formed by the first conductor pattern 6 and the second conductor 102.

The first conductor pattern 6 is a linear conductor pattern parallel to the Y axis, and is connected at one end thereof to the feeder circuit 2. The second conductor 102 is a conductor having a substantially U shape, and is connected at one end thereof to the ground 5 on the circuit board 4 and connected at another end thereof to the other end of the first conductor pattern 6. The second conductor 102 forms the minute loop antenna 1 together with the first conductor pattern 6, and is provided such that the loop surface formed by the minute loop antenna 1 is parallel to the YZ plane. In addition, the second conductor 102 is provided such that a normal vector n of a surface surrounded by the second conductor 102 and the first conductor pattern 6 is directed in the X axis direction.

Figure 14:
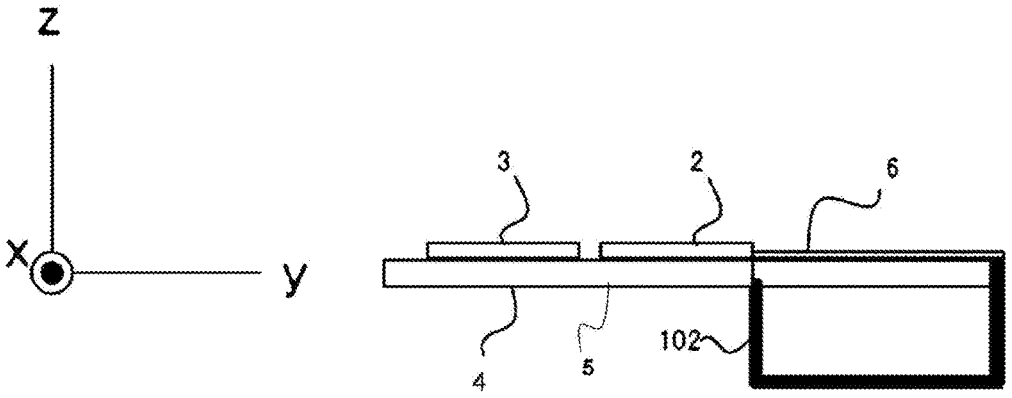
FIG. 14 is a side view of the antenna device according to Embodiment 6.

Next, the connection between the second conductor 102 and the first conductor pattern 6 will be described with reference to FIG. 14. FIG. 14 is a side view of the antenna device according to Embodiment 6. For the connection between the second conductor 102 and the first conductor pattern 6, a part of the second conductor 102 is inserted into a hole provided in the circuit board 4, and the first conductor pattern 6 and the conductor 102 are connected to each other by means of solder or the like. Accordingly, the minute loop antenna 1 having a loop surface parallel to the YZ plane is produced by the first conductor pattern 6 and the second conductor 102.

In the antenna device according to the present embodiment as well, since the loop surface formed by the minute loop antenna 1 is provided parallel to the YZ plane, the magnetic current M flowing through the loop surface is not hindered, and flow of the minute loop mode electric current I flowing through the minute loop antenna 1 is also not hindered. Therefore, an increase in the dipole mode electric current I' flowing on the circuit board 4 is suppressed. As a result, influence of the human body of the user on the antenna performance can be suppressed. In addition, the polarized waves and emission pattern of the minute loop antenna 1 according to Embodiment 6 are the same as those in the case of the minute loop antenna 1 according to Embodiment 1. Thus, the radio waves from the portable apparatus toward the vehicle are intensified by utilizing reflection on the trunk of the user, so that an effect of extending the working distance of the remote keyless system is also obtained.

Furthermore, according to the antenna device according to the present embodiment, since a part of the minute loop antenna 1 is formed by the first conductor pattern 6, it is possible to form the first conductor pattern 6 when the circuit pattern on the circuit board 4 is formed, and components for producing the minute loop antenna 1 by an additional conductor are reduced. As a result, there is an effect that the manufacturing cost for the antenna device is reduced. Furthermore, since a part of the minute loop antenna 1 is formed on the circuit board 4, there is also an effect that the minute loop antenna 1 is hard to deform.

Figure 15:
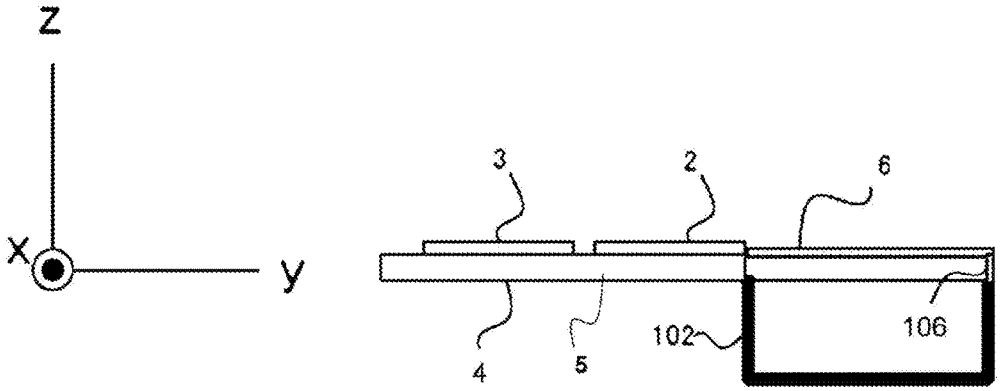
FIG. 15 is a side view of the antenna device according to Embodiment 6 and is an example in which a conductor is electrically connected via a through hole.

In the present embodiment, for the connection between the second conductor 102 and the first conductor pattern 6, a part of the second conductor 102 is inserted into the hole provided in the circuit board 4, and the first conductor pattern 6 and the conductor 102 are connected to each other by means of solder. However, the through hole 106 may be used for the connection between the second conductor 102 and the first conductor pattern 6. FIG. 15 is a side view of the antenna device according to Embodiment 6 and is an example in which the conductor is electrically connected by the through hole 106. In this example, the loop-shaped minute loop antenna 1 is formed by the first conductor pattern 6, the through hole 106, and the second conductor 102. Such a configuration eliminates the need for inserting the second conductor 102 into the hole of the circuit board 4 and performing soldering, and allows the first conductor pattern 6 and the second conductor 102 to be easily connected to each other.

In the antenna device according to the present embodiment, the minute loop antenna 1 is formed by: the first conductor pattern 6 provided on the upper surface of the circuit board 4; and the second conductor 102 provided on the lower surface of the circuit board 4. However, a second conductor pattern 9 may be formed on the lower surface of the circuit board 4, and a first conductor 101 may be formed on the upper surface of the circuit board 4.

Figure 16:
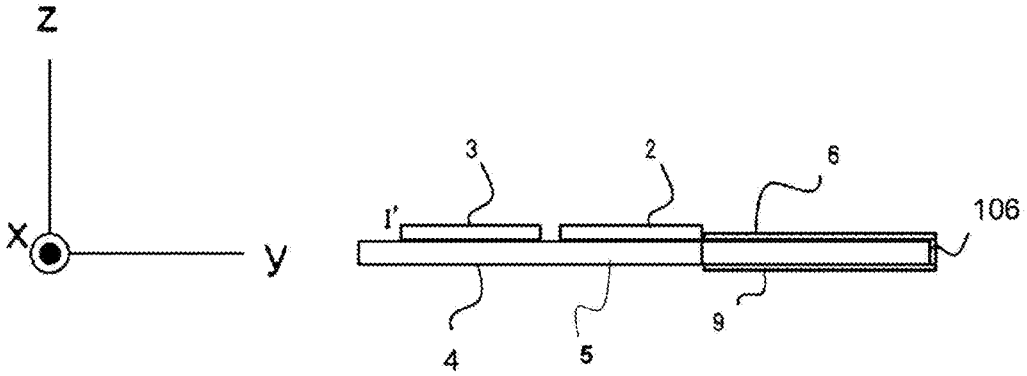
FIG. 16 is a side view of the antenna device according to Embodiment 6 and is an example in which a minute loop antenna 1 is formed by conductor patterns formed on the surface of the circuit board.

Furthermore, each of the first conductor 101 and the second conductor 102 may be formed by a conductor pattern. FIG. 16 is a side view of the antenna device according to Embodiment 6 and is an example in which the minute loop antenna 1 is formed by conductor patterns formed on the surface of the circuit board 4. The second conductor pattern 9 is connected at one end thereof to the ground 5 on the circuit board 4 and at another end thereof to the first conductor pattern 6 via the through hole 106. The loop-shaped minute loop antenna 1 is formed by the first conductor pattern 6, the through hole 106, and the second conductor pattern 9. In this example, since the entire minute loop antenna 1 is formed by the conductor patterns formed on the circuit board 4, the minute loop antenna 1 can be produced simultaneously with formation of the circuit patterns on the circuit board 4, so that the production of the minute loop antenna 1 is simplified.

Figure 17:
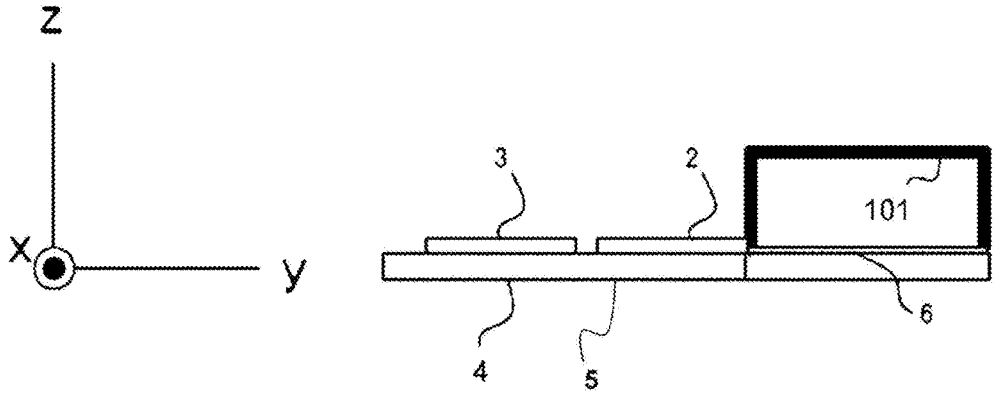
FIG. 17 is a side view of the antenna device according to Embodiment 6 and is an example in which a conductor pattern and a first conductor are provided on the upper surface of the circuit board.

Moreover, it is possible to remove the second conductor 102 provided on the lower surface of the circuit board 4 of the antenna device shown in FIG. 11, and form the first conductor pattern 6 on the upper surface of the circuit board 4 instead. FIG. 17 is a side view of the antenna device according to Embodiment 6 and is an example in which the first conductor pattern 6 and the first conductor 101 are provided on the upper surface of the circuit board 4. In the case of the configuration shown in FIG. 17, the operation of forming the minute loop antenna 1 is completed only on one surface of the circuit board 4, and thus it is not necessary to perform a process of forming the through hole 106 or a boring process on the circuit board 4. Furthermore, since it is not necessary to form the through hole 106 in the circuit board 4, the circuit board 4 is not limited to a multilayer board. Therefore, a further cost reducing effect and a workability improving effect are obtained.

Embodiment 7

Figure 18:
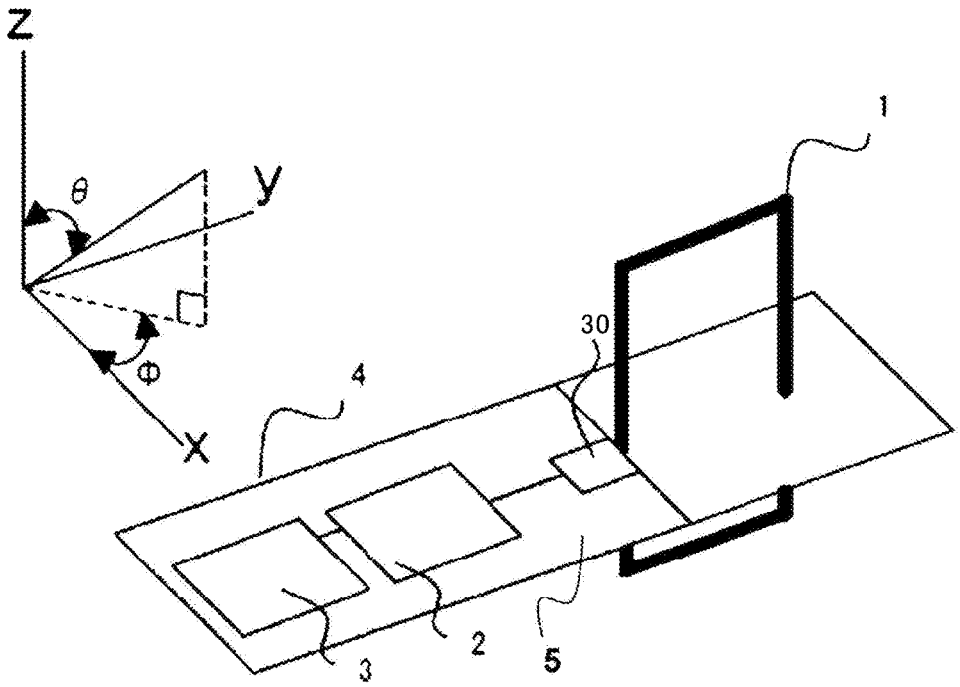
FIG. 18 is a perspective view of an antenna device according to Embodiment 7.

Hereinafter, an antenna device according to Embodiment 7 will be described with reference to FIG. 18. The antenna device according to Embodiment 7 is characterized in that a balanced-to-unbalanced conversion circuit 30 is provided between the minute loop antenna 1 and the feeder circuit 2. FIG. 18 is a perspective view of the antenna device according to Embodiment 7. In the following description, the components that are the same as those shown in FIGS. 1 to 4 and 9 to 17 are designated by the same numerals, and the description thereof is omitted.

The balanced-to-unbalanced conversion circuit 30 is connected at one end thereof to the feeder circuit 2 and connected at another end thereof to the minute loop antenna 1. The balanced-to-unbalanced conversion circuit 30 converts an unbalanced signal supplied from the feeder circuit 2 to a balanced signal, and supplies the balanced signal to the minute loop antenna 1. As a result, the dipole mode electric current I' is suppressed from flowing through the circuit board 4, so that influence of the radio waves emitted from the arm of the user is small and an antenna device having stable transmission performance is obtained.

Embodiment 8

Hereinafter, an antenna device according to Embodiment 8 will be described with reference to FIGS. 19 to 21. The antenna device according to Embodiment 8 is characterized in that the minute loop antenna 1 is arranged on the circuit board 4 so as to be displaced in the normal direction of the loop surface of the minute loop antenna 1. In the following description, the components that are the same as those shown in FIGS. 1 to 4 and 9 to 18 are designated by the same numerals, and the description thereof is omitted.

Figure 19:
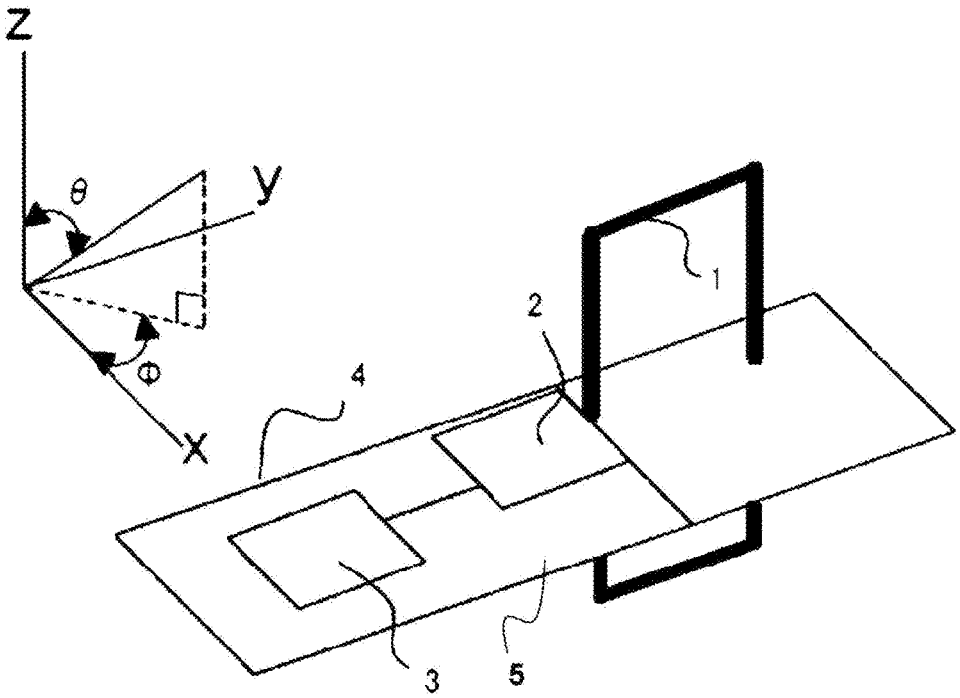
FIG. 19 is a perspective view of an antenna device according to Embodiment 8.

FIG. 19 is a perspective view of the antenna device according to Embodiment 8. In FIG. 19, the minute loop antenna 1 is arranged on the circuit board 4 so as to be displaced in the normal direction of the loop surface of the minute loop antenna 1. Specifically, the minute loop antenna 1 is arranged on the circuit board 4 so as to be displaced in the −X axis direction.

Next, an electric current flowing through the circuit board 4 in the antenna device according to Embodiment 8 will be described with reference to FIG. 20. FIG. 20 is a diagram illustrating the electric current flowing through the circuit board 4 in the antenna device according to Embodiment 8. In FIG. 20, for simplification of the drawing, the circuit pattern on the circuit board 4 is omitted. In addition, an oscillator 40 is shown at a connection point between the feeder circuit 2 and the minute loop antenna 1, that is, a feeding point.

Figure 20:
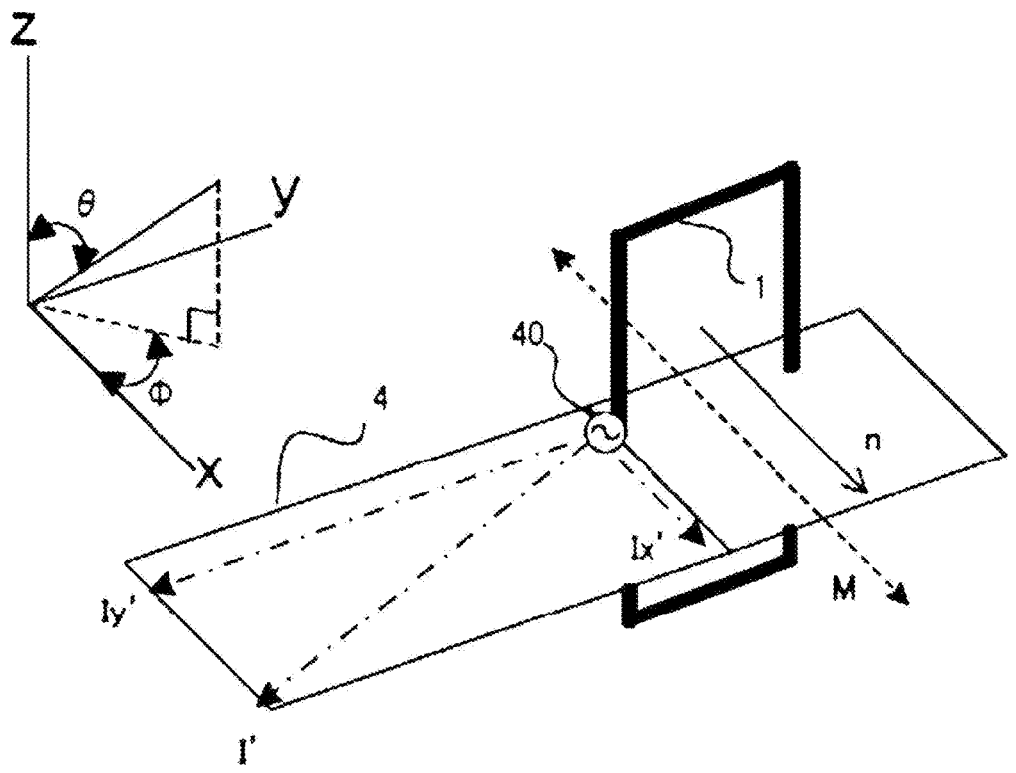
FIG. 20 is a diagram illustrating an electric current flowing through a circuit board in the antenna device according to Embodiment 8.

In the case where the feeding point is displaced on the circuit board 4 in the normal direction of the loop surface of the minute loop antenna 1, the dipole mode electric current I' flowing through the circuit board 4 is the sum of a dipole mode electric current Ix' in the X axis direction and a dipole mode electric current Iy' in the −Y axis direction, and flows from the feeding point in the diagonal direction of the circuit board 4 as shown in FIG. 20. That is, the dipole mode electric current I' in the present embodiment indicates that the emission pattern from this dipole mode electric current I' is changed as compared to the dipole mode electric current I' in the antenna device shown in FIG. 1. For example, as shown in FIG. 20, if the dipole mode electric current I' flows through the circuit board 4, the emission pattern from the dipole mode electric current I' is a pattern rotated anticlockwise as seen from the +Z axis direction, as compared to the case where the feeding point is present at a midpoint on the X axis (FIG. 1).

Figure 21:
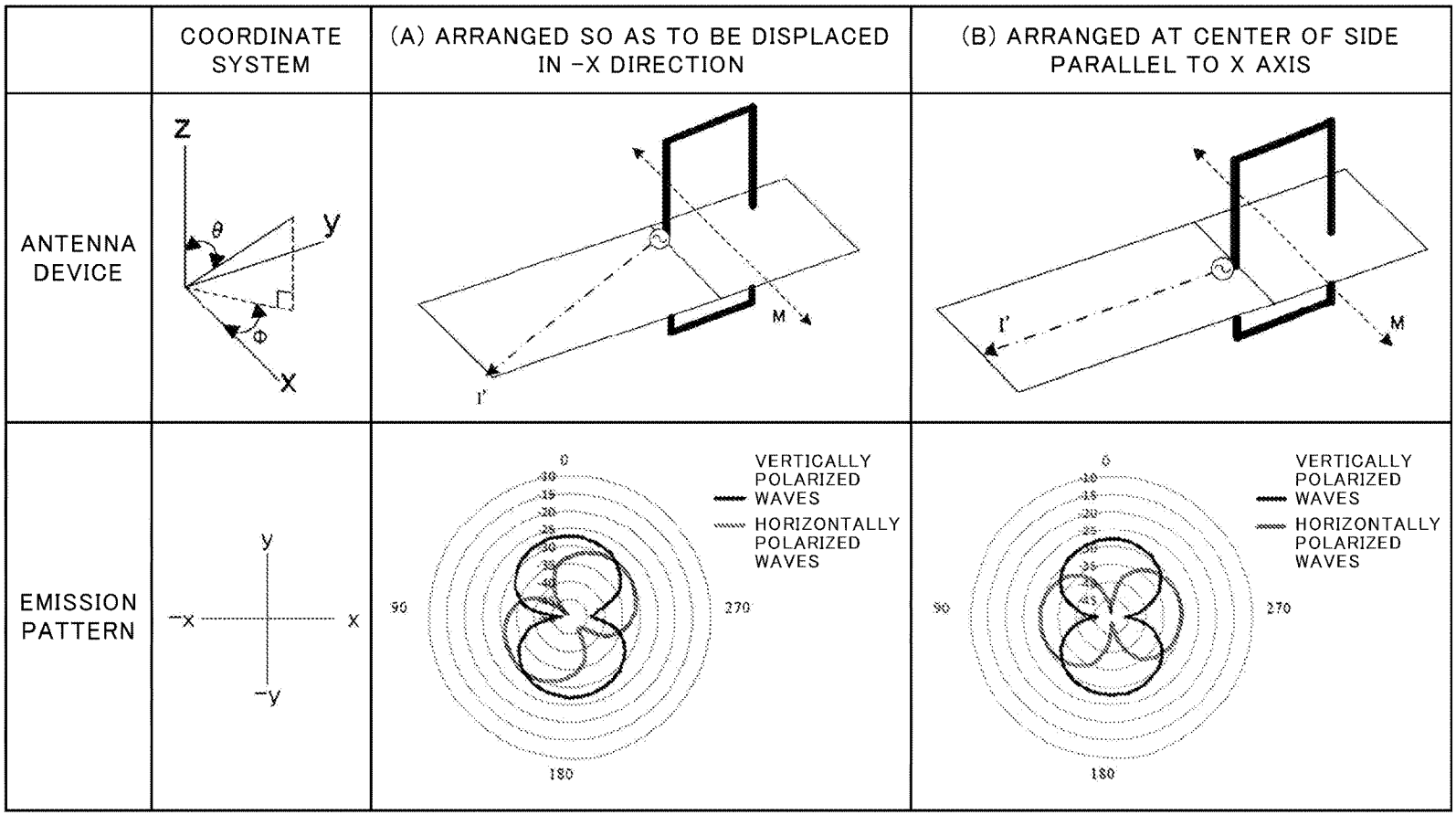
FIG. 21 is a diagram illustrating effects of the antenna device according to Embodiment 8.

FIG. 21 is a diagram illustrating effects of the antenna device according to Embodiment 8. The unit of values in the emission pattern at the lower row is dBi. In FIG. 21, vertically polarized waves are emitted by the magnetic current M, and horizontally polarized waves are emitted from the dipole mode electric current I'. As described above, it is experimentally confirmed that the directivity of the electric field of the horizontally polarized waves emitted from the dipole mode electric current I' can be changed by changing the position of the feeding point. Whereas the gain of the horizontally polarized waves in the Y axis direction, which is the direction toward the vehicle, is about −35 dBi in arrangement (A) in FIG. 21, the gain of the horizontally polarized waves in the Y direction is −50 dBi in arrangement (B). In the case of observation in the obliquely rightward and frontward direction from the user, the gain of the horizontally polarized waves is −30 dBi in the arrangement (A) and is −35 dBi in the arrangement (B). Moreover, the gain of the vertically polarized waves is almost the same in the arrangements (A) and (B). Therefore, as in the antenna device according to the present embodiment, the directivity of the electric field of the horizontally polarized waves can be controlled by moving the position of the feeding point on the circuit board 4 in the normal direction of the loop surface, so that an antenna device is obtained which emits electric fields of both vertically polarized waves and horizontally polarized waves in the direction toward the vehicle.

Embodiment 9

Hereinafter, an antenna device according to Embodiment 9 will be described with reference to FIGS. 22 and 23. The antenna device according to Embodiment 9 is characterized in that a capacitor 60 is provided at a connection point between the minute loop antenna 1 and the ground 5 on the circuit board 4. In the following description, the components that are the same as those shown in FIGS. 1 to 4 and 9 to 20 are designated by the same numerals, and the description thereof is omitted.

Figure 22:
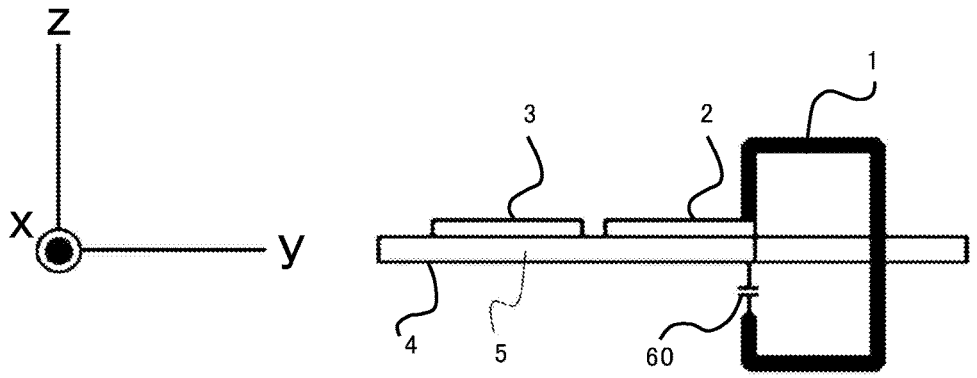
FIG. 22 is an example in which a capacitor 60 is inserted between a minute loop antenna and a ground in an antenna device according to Embodiment 9.

FIG. 22 is an example in which the capacitor 60 is inserted between the minute loop antenna 1 and the ground 5 in the antenna device according to Embodiment 9. The capacitor 60 is connected in series between the minute loop antenna 1 and the ground 5 on the circuit board 4. The capacitance of the capacitor 60 is determined such that the minute loop antenna 1 resonates with the operating frequency of the antenna device. With such a configuration, impedance matching is provided between the feeder circuit 2 and the minute loop antenna 1, and power outputted from the feeder circuit 2 is efficiently supplied to the minute loop antenna 1.

Although the capacitor 60 is inserted between the minute loop antenna 1 and the ground 5 on the circuit board 4, even if the capacitor 60 is inserted between the minute loop antenna 1 and the feeder circuit 2, the same effects are obtained. In addition, in the antenna device according to the present embodiment, although the example has been described in which the one capacitor 60 is provided, as long as the capacitance is adjusted as appropriate, the capacitor 60 may be inserted at each of both ends of the minute loop antenna 1, or impedance matching may be provided between the minute loop antenna 1 and the feeder circuit 2 by using three or more capacitors 60.

Figure 23:
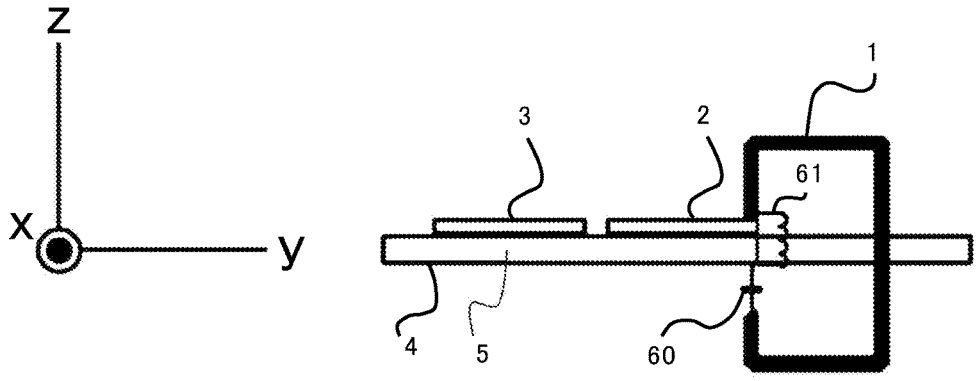
FIG. 23 is an example in which an inductor is provided in parallel with respect to a feeding point of the minute loop antenna in the antenna device according to Embodiment 9.

FIG. 23 is an example in which an inductor 61 is provided in parallel with respect to the feeding point of the minute loop antenna 1 in the antenna device according to Embodiment 9. The inductor 61 provides impedance matching between the feeder circuit 2 and the minute loop antenna 1. The inductor 61 is provided in parallel with respect to the feeding point. With such a configuration, power outputted from the feeder circuit 2 is efficiently supplied to the minute loop antenna 1. In FIG. 23, the one capacitor 60 is inserted between the circuit board 4 and the minute loop antenna 1, but the number of the capacitors 60 may be plural.

Embodiment 10

Figure 24:
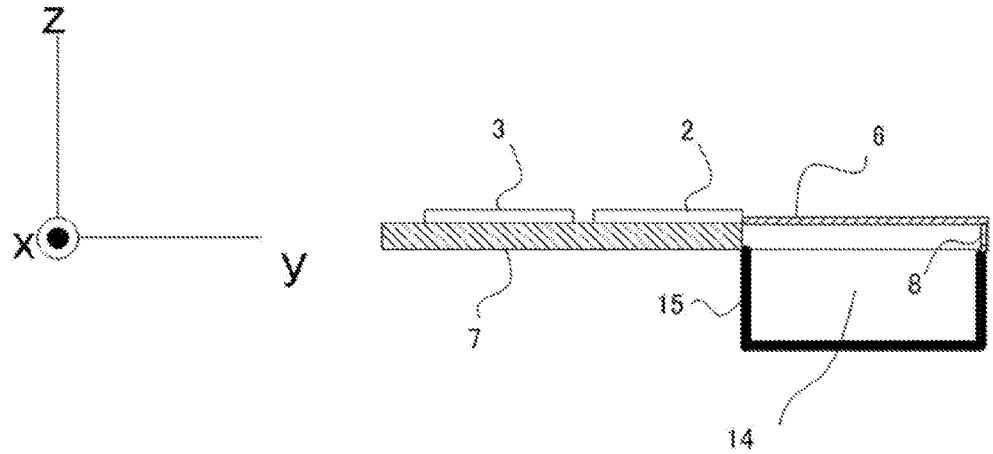
FIG. 24 is a side view of an antenna device according to Embodiment 10.
Figure 25A:
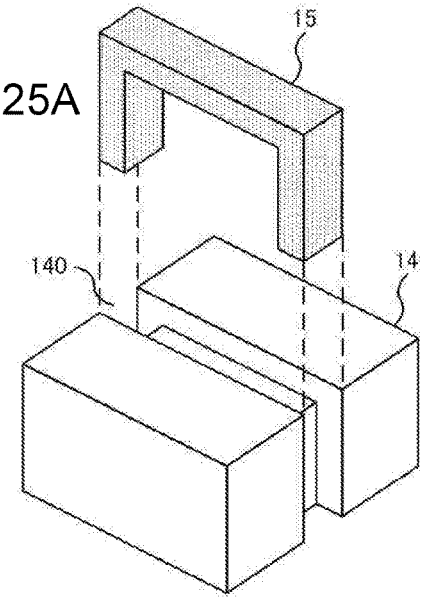
FIGS. 25A and 25B are examples in which a minute loop antenna 1 is formed by a resinous component 14 and a conductor 15 in the antenna device according to Embodiment 10.
Figure 25B:
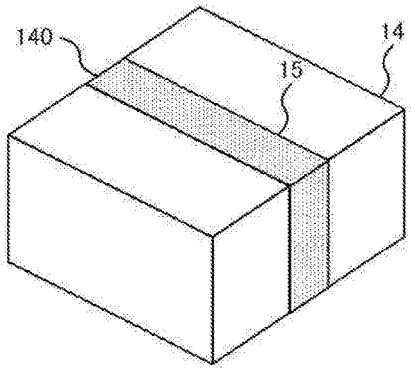

Hereinafter, an antenna device according to Embodiment 10 will be described with reference to FIGS. 24, 25A and 25B. In the following description, the components that are the same as those shown in FIGS. 1 to 4 and 9 to 20 are designated by the same numerals, and the description thereof is omitted. FIG. 24 is a side view of the antenna device according to Embodiment 10. FIGS. 25A and 25B shows a resinous component 14 and a conductor 15 forming the minute loop antenna 1 in the antenna device according to Embodiment 10. In the antenna device according to Embodiment 10, the resinous component 14 and the conductor 15 are provided so as to fill the interior of the loop surface of the minute loop antenna 1. Furthermore, in the embodiment shown in FIGS. 25A and 25B, a groove 140 having a width that is substantially the same as that of the conductor 15 is formed in the resinous component 14, and the conductor 15 is fitted into the groove 140. FIG. 25A shows a state before assembling, and FIG. 25B shows a state after assembling.

Such a configuration provides a structure in which the groove 140 formed in the resinous component 14 holds the conductor 15 when the conductor 15 is provided perpendicularly on a circuit board 7 during assembling of the antenna device. Furthermore, since the conductor 15 is fitted into the groove, the conductor 15 is hard to be displaced. That is, the manufacture is made easy, so that a cost reducing effect and a workability improving effect are obtained. In addition, the shape of the minute loop antenna 1 is retained, so that an effect of stabilizing the communication performance of the antenna device is also obtained.

The manner of formation of the groove 140 in the resinous component 14 is not limited to both the upper surface and side surfaces of the resinous component 14. FIGS. 26A, 26B and 26C shows modifications in which the minute loop antenna 1 is formed by the resinous component 14 and the conductor 15 in the antenna device according to Embodiment 10. FIG. 25 shows the groove formed as holding means on both the side surfaces and the upper surface of the resinous component 14 such that the conductor 15 is fitted therein. For example, a groove 140*a* or 140*b* may be formed only on side surfaces of a resinous component 14*a* as in FIG. 26A or only on the upper surface of a resinous component 14*b* as in FIG. 26B. Alternatively, a groove 140*c* having a depth smaller than the thickness of the conductor 15 may be formed on both the upper surface and side surfaces of a resinous component 14*c* as in FIG. 26C. Still alternatively, the position of the groove having a depth different from the thickness of the conductor 15 is not limited to both the side surfaces and the upper surface of the resinous component 14 shown in FIG. 26C, and such a groove may be formed only on the side surfaces or only on the upper surface. Still alternatively, grooves on the side surfaces of the resinous component 14 and a groove on the upper surface of the resinous component 14 may be formed with different depths, or a groove having a depth equal to the thickness of the conductor 15 and a groove having a depth different from the thickness of the conductor 15 may be combined. Still alternatively, for example, as long as the conductor can be held by grooves on both side surfaces, a space may be present between the upper surface of the resinous component and the conductor.

Figure 27A:
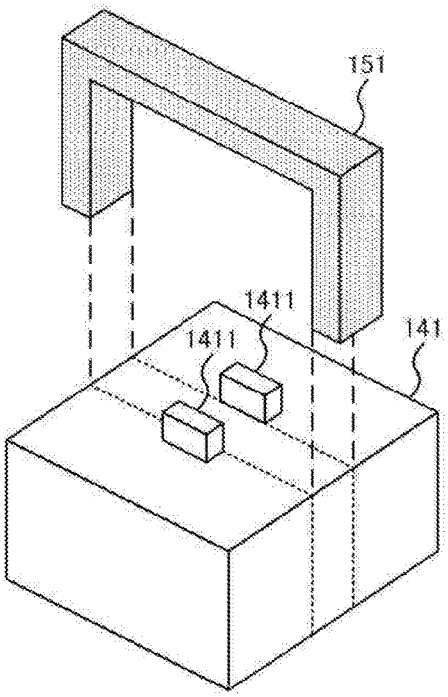
FIGS. 27A and 27B are examples showing another configuration of the antenna device according to Embodiment 10.
Figure 27B:
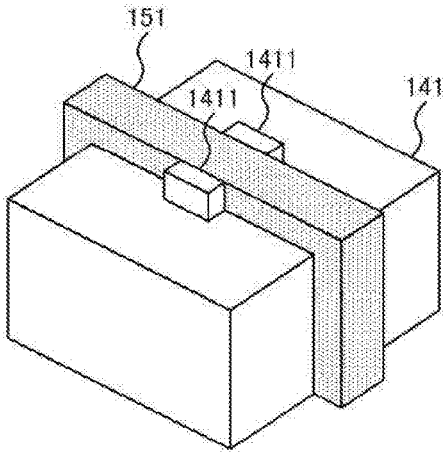

Another configuration of the antenna device according to Embodiment 10 will be described with reference to FIGS. 27A and 27B. FIGS. 27A and 27B shows a resinous component 141 and a conductor 151 forming the minute loop antenna 1 in the antenna device according to Embodiment 10. As shown, by using the resinous component 141 provided with guides 1411, not with a groove, the conductor 151 can be fixed such that the positional relationship between the conductor 151 and the resinous component 141 is not changed. In FIGS. 27A and 27B, a pair of the guides 1411 are provided on the resinous component 141, but the guides 1411 are not limited to one pair, and a plurality of guides 1411 may be provided. The height of each guide 1411 may not be necessarily equal to that of the conductor 151. FIG. 27A shows a state before assembling, and FIG. 27B shows a state after assembling.

Figure 28:
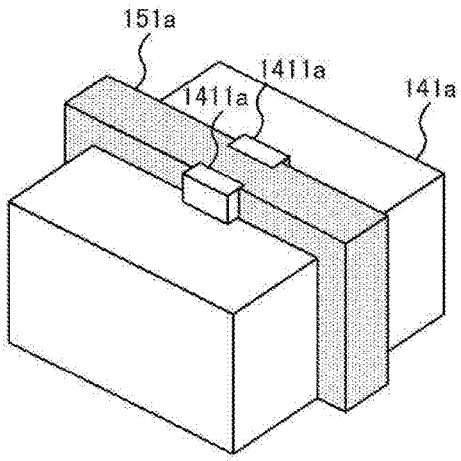
FIG. 28 is an example in which a resinous component 141*a* and a conductor 151*a* forming a minute loop antenna 1 are formed in the antenna device according to Embodiment 10.

Furthermore, FIG. 28 shows a resinous component 141*a* and a conductor 151*a* forming the minute loop antenna 1 in the antenna device according to Embodiment 10. Guides 1411*a* in FIG. 28 are changed from the guides 1411 in FIG. 27A and FIG. 27B such that the interval at which the conductor 151*a* is sandwiched is narrow. Thus, by providing cuts in the conductor 151*a* according to the interval between the guides 1411*a* such that a portion to be sandwiched between the guides 1411*a* is made narrow, the resinous component 141*a* and the conductor 151*a* are allowed to be assembled.

Such a configuration provides a structure in which the guides 1411 or 1411*a* formed on the resinous component 141 or 141*a* hold the conductor 151 or 151*a* when the conductor 151 or 151*a* is provided perpendicularly on the circuit board 7 during assembling of the antenna device. Furthermore, since the conductor 151 or 151*a* is sandwiched between the guides 1411 or 1411*a*, the conductor 151 or 151*a* is hard to be displaced. That is, the manufacture is made easy, so that a cost reducing effect and a workability improving effect are obtained. In addition, the shape of the minute loop antenna 1 is retained, so that an effect of stabilizing the communication performance of the antenna device is also obtained.

Figure 29A:
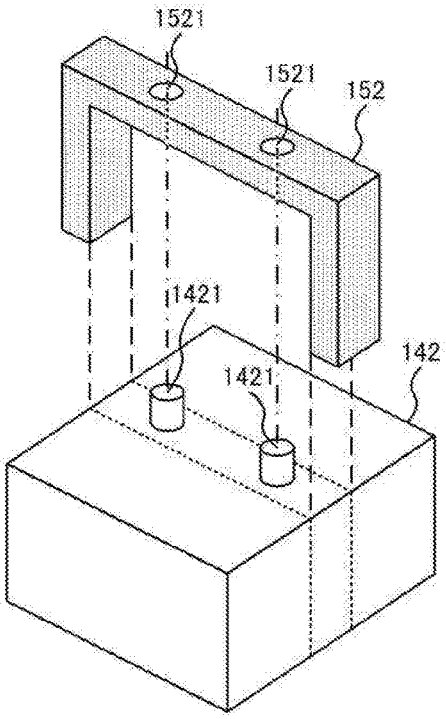
FIGS. 29A and 29B are examples showing another configuration of the antenna device according to Embodiment 10.
Figure 29B:
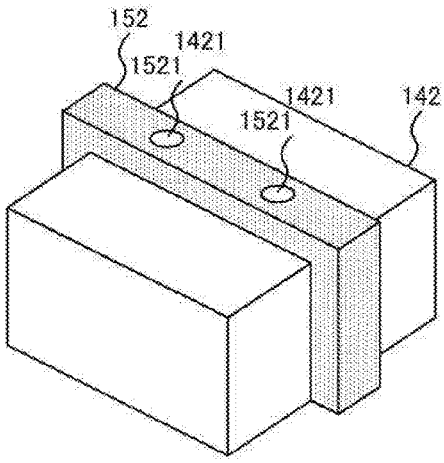

Still another configuration of the antenna device according to Embodiment 10 will be described with reference to FIGS. 29A and 29B. FIGS. 29A and 29B shows a resinous component 142 and a conductor 152 forming the minute loop antenna 1 in the antenna device according to Embodiment 10. As shown, projections 1421 provided on the resinous component 142 are inserted into holes 1521 provided in the conductor 152, whereby the conductor 152 can be fixed such that the positional relationship between the conductor 152 and the resinous component 142 is not changed. In FIGS. 29A and 29B, the two projections 1421 are provided on the resinous component 142, but the number of the projections 1421 is not limited to two, and one or three or more projections 1421 may be provided. In FIG. 29A, shows a state before assembling, and FIG. 29B shows a state after assembling.

Figure 30A:
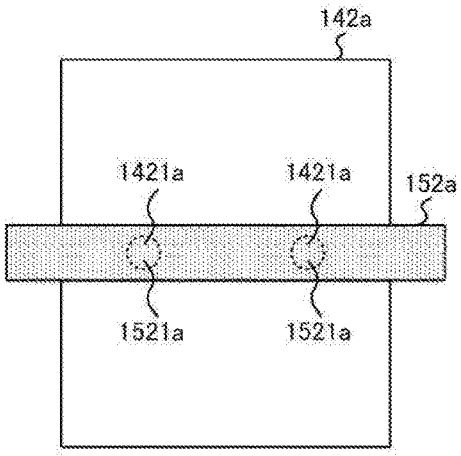
FIGS. 30A and 30B are examples of a top view after a resinous component 142 and a conductor 152 forming a minute loop antenna 1 are assembled in the antenna device according to Embodiment 10.
Figure 30B:
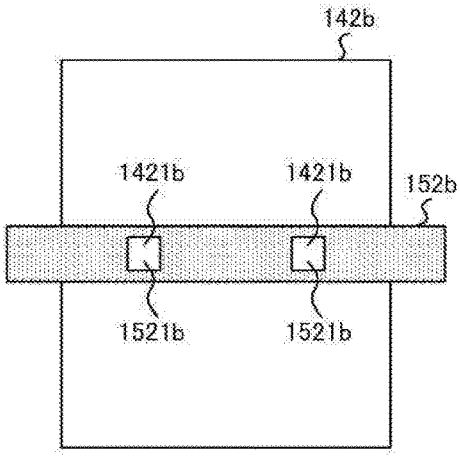

Furthermore, FIGS. 30A and 30B shows a top view after the resinous component 142 and the conductor 152 forming the minute loop antenna 1 are assembled in the antenna device according to Embodiment 10. In FIGS. 29A and 29B, regarding the relationship between the projections 1421 and the holes 1521 as holding means, the projections 1421 are and the holes 1521 are formed such that the projections 1421 are received in the holes 1521 penetrating the conductor 152. However, as in FIG. 30A, in holes 1521*a* that do not penetrate a conductor 152*a*, projections 1421*a* of a resinous component 142*a* that are matched with the depths of the holes 1521*a* may be received. Alternatively, as in FIG. 30B, for example, square projections 1421*b* of a resinous component 142*b* may be received in square holes 1521*b* of a conductor 152*b*. At this time, the square holes 1521*b* may penetrate the conductor 152*b* or may not penetrate the conductor 152*b*, as long as the square holes 1521*b* function as holding means. In each penetrating hole 1521*b*, the projection 1421*b* shorter or longer than the depth of the penetrating hole 1521*b* (the thickness of the conductor 152*b*) may be received. Alternatively, a space may be present between the upper surface of the resinous component and the conductor, for example, as long as the conductor can be held by a combination of projections and holes, or a space may be present between the side surface of the resinous component and the conductor by providing a plurality of projections and a plurality of holes. Moreover, each projection 1421*b* is not limited to a square column, and the shape of each projection 1421*b* may be any shape other than the cylindrical column shown in FIGS. 29A and 29B, as long as the projection 1421*b* can be received in the hole 1521*b*.

Such a configuration provides a structure in which the resinous component 142, 142*a*, or 142*b* holds the conductor 152, 152*a*, or 152*b* when the conductor 152, 152*a*, or 152*b* is provided perpendicularly on the circuit board 7 during assembling of the antenna device. Furthermore, since the holes 1521, 1521*a*, or 1521*b* of the conductor 152, 152*a*, or 152*b* are fixed by the projections 1421, 1421*a*, or 1421*b* of the resinous component 142, 142*a*, or 142*b*, the conductor 152, 152*a* or 152*b* is hard to be displaced. That is, the manufacture is made easy, so that a cost reducing effect and a workability improving effect are obtained. In addition, the shape of the minute loop antenna 1 is retained, so that an effect of stabilizing the communication performance of the antenna device is also obtained.

Figure 31A:
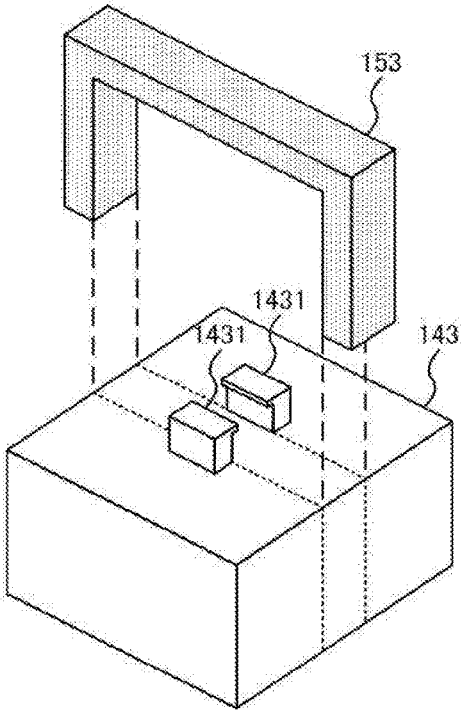
FIGS. 31A and 31B are example showing another configuration of the antenna device according to Embodiment 10.
Figure 31B:
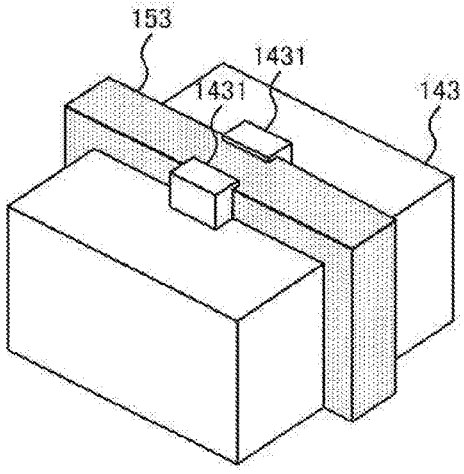

Still another configuration of the antenna device according to Embodiment 10 will be described with reference to FIGS. 31A and 31B. FIGS. 31A and 31B shows a resinous component 143 and a conductor 153 forming the minute loop antenna 1 in the antenna device according to Embodiment 10. In FIG. 27, the guides 1411 that do not have claws are formed on the resinous component 141. However, in FIGS. 31A and 31B, by using the resinous component 143 provided with guides 1431 having claws, the conductor 153 can be fixed such that the positional relationship between the conductor 153 and the resinous component 143 is not changed. In FIGS. 31A and 31B, a pair of the guides 1431 having claws are provided on the resinous component 143, but the number of the guides 1431 is not limited to one pair, and a plurality of guides 1431 having claws may be provided. In FIG. 31A, shows a state before assembling, and FIG. 31B shows a state after assembling.

Such a configuration provides a structure in which the guides 1431 having claws and formed on the resinous component 143 hold the conductor 153 when the conductor 153 is provided perpendicularly on the circuit board 7 during assembling of the antenna device. Furthermore, since the conductor 153 is fitted to and held between the guides 1431 having claws, the conductor 153 is hard to be displaced. The conductor 153 and the resinous component 143 are allowed to be mounted on the circuit board after the conductor 153 and the resinous component 143 are assembled to be integrated with each other, so that the operation in the final assembling process can be reduced. That is, the manufacture is made easy, so that a cost reducing effect and a workability improving effect are obtained. In addition, the shape of the minute loop antenna 1 is retained, so that an effect of stabilizing the communication performance of the antenna device is also obtained.

The resinous component 14, 141, 142, or 143 may be used also as a casing for the LF communication coil 12. Accordingly, the present embodiment can be implemented without adding a new component.

In the diagrams illustrating Embodiment 10, the resinous component that fully fills the loop surface of the minute loop antenna is used. However, as long as the conductor 15, 151, 152, or 153 can be held perpendicularly on the circuit board 7, the resinous component may be smaller than the size of the loop formed by the conductor.

Embodiment 11

Figure 32A:
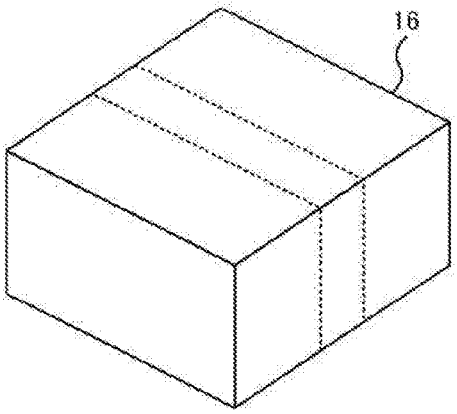
FIGS. 32A and 32B are an example in which a minute loop antenna 1 is formed by a resinous component 16 and a conductor 17 in an antenna device according to Embodiment 11.
Figure 32B:
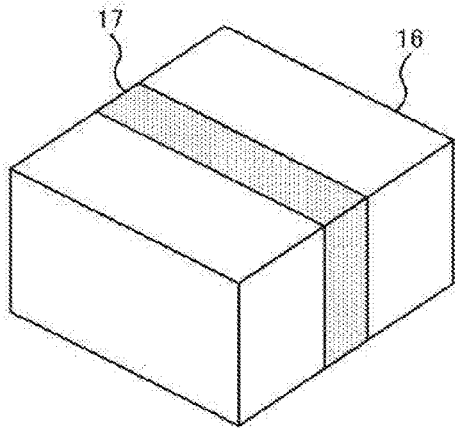

Hereinafter, an antenna device according to Embodiment 11 will be described with reference to FIGS. 32A and 32B. In the following description, the components that are the same as those shown in FIGS. 1 to 4 and 9 to 20 are designated by the same numerals, and the description thereof is omitted. FIGS. 32A and 32B shows a resinous component 16 and a conductor 17 forming the minute loop antenna 1 in the antenna device according to Embodiment 11. The antenna device according to Embodiment 11 is characterized in that the conductor 17 is formed on the resinous component 16 provided on the circuit board 7, by printing with a conductive ink.

With such a configuration, the conductor 17 is integrated with the resinous component 16. Thus, mounting the resinous component 16 onto the circuit board 7 corresponds to mounting the conductor 17 onto the circuit board 7. Furthermore, according to Embodiment 11, it is not necessary to produce the antenna with a sheet metal or the like, so that a cost reducing effect and a workability improving effect are obtained. In addition, since the conductor 17 is formed by printing, the shape of the conductor 17 is not changed, so that an effect of stabilizing the communication performance of the antenna device is also obtained. The conductor 17 that is printed on a tape with a conductive ink beforehand may be attached to the resinous component 16 to form the minute loop antenna 1.

The resinous component 16 may be used also as a casing for the LF communication coil 12. Accordingly, the present embodiment can be implemented without adding a new component.

FIGS. 32A and 32B shows a block-like component as the resinous component 16. The used resinous component 16 is not limited to a block-like component, and it is obvious that the same effects are obtained even when the hollow loop shape is retained by, for example, printing a conductor on a resinous sheet and bending or folding the sheet.

Embodiment 12

Figure 33:
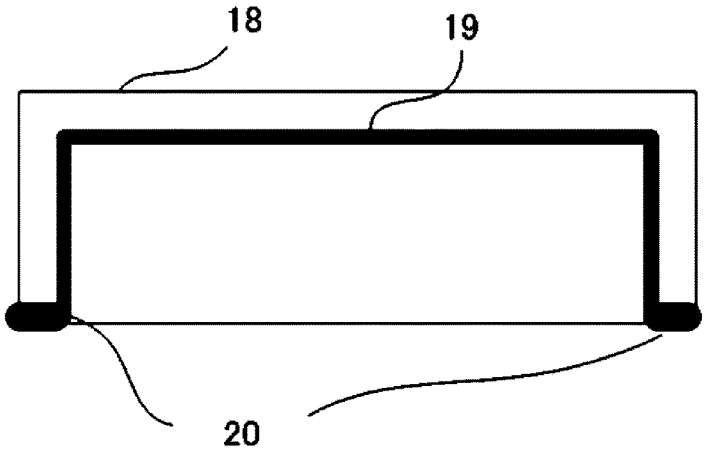
FIG. 33 is an example in which a minute loop antenna 1 is formed by a resinous component 18, a conductor 19, and terminals 20 in an antenna device according to Embodiment 12.

Hereinafter, an antenna device according to Embodiment 12 will be described with reference to FIG. 33. In the following description, the components that are the same as those shown in FIGS. 1 to 4 and 9 to 20 are designated by the same numerals, and the description thereof is omitted. FIG. 33 shows a resinous component 18, a conductor 19, and terminal portions 20 forming the minute loop antenna 1 in the antenna device according to Embodiment 12. The antenna device according to Embodiment 12 is characterized in that at least a part of the conductor 19 is included within the resinous component 18 provided on the circuit board 7, by insert molding or the like. The terminal portions 20 for allowing for electrical access to the conductor 19 are provided on the surface of the resinous component 18. Each terminal portion 20 may be a part of the conductor 19 or may be provided as an independent component.

With such a configuration, the conductor 19 is integrated with the resinous component 18. Thus, mounting the resinous component 18 onto the circuit board 7 corresponds to mounting the conductor 19 onto the circuit board 7. Thus, the resinous component 18 serves to perpendicularly hold the minute loop antenna 1 on the circuit board 7, so that an assembly workability improving effect is obtained. Since the conductor 19 is fixed within the resinous component 18, the shape of the conductor 19 is not changed, so that an effect of stabilizing the communication performance of the antenna device is also obtained.

The resinous component 18 may be used also as a casing for the LF communication coil 12. In this case, the LF communication coil 12 and the conductor 19 are provided together within the single resin casing.

In FIG. 33, the terminals 20 are shown as soldering pads mounted by SMT (Surface Mount Technology). However, the form of the terminals 20 is not limited thereto, and each terminal 20 may have a shape like a pin to be inserted into a through hole as in a DIP (Dual-in-line Package) component.

Embodiment 13

Figure 34:
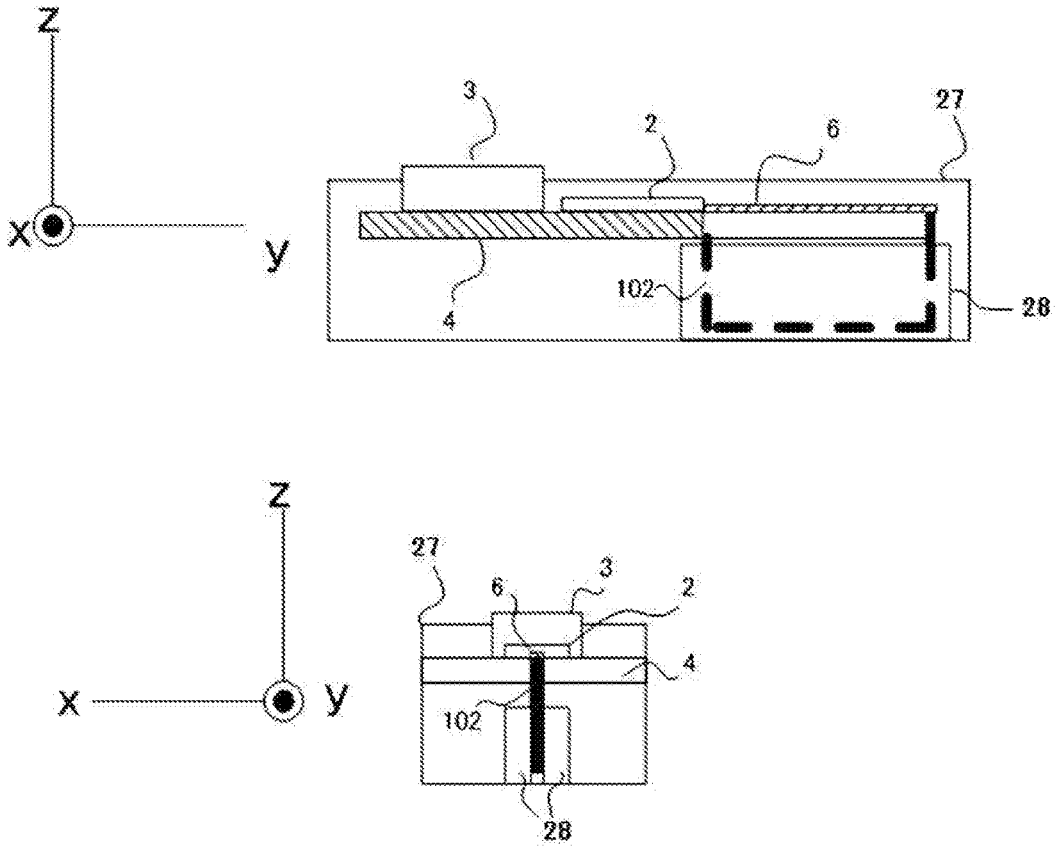
FIG. 34 is an example showing the configuration of a protective cover 27, of an antenna device according to Embodiment 13, provided with a guide portion 28 in the antenna device.

Hereinafter, an antenna device according to Embodiment 13 will be described with reference to FIG. 34. FIG. 34 is an example showing the configuration of a protective cover 27 of the antenna device provided with a guide portion 28 in the antenna device according to Embodiment 13. In the following description, the components that are the same as those shown in FIGS. 1 to 4 and 9 to 20 are designated by the same numerals, and the description thereof is omitted. In Embodiments 10 to 12, the method for keeping the loop surface of the minute loop antenna and the circuit board such that the loop surface of the minute loop antenna and the circuit board are perpendicular to each other; and improving the workability and stability, is disclosed while the example in which the minute loop antenna 1 is fixed and held on the circuit board 7 is shown. Embodiment 13 is characterized in that the minute loop antenna 1 is held by a structure provided in the protective cover (protective casing) 27 of the antenna device. In FIG. 34, by integrally providing the guide portion 28 to the protective cover 27, the conductor 102 is held such that the minute loop antenna 1 is provided perpendicularly on the circuit board 4.

According to Embodiment 13 as well, since the loop surface of the minute loop antenna can be held so as to be perpendicular to the circuit board, an assembly workability improving effect is obtained similarly as in Embodiments 10 to 12. Furthermore, since the minute loop antenna of the present embodiment is fixed to the protective cover formed from a material that does not easily deform, such as a resin, deformation of the minute loop antenna 1 is prevented, and an effect of stabilizing the communication performance of the antenna device is also obtained.

Embodiment 14

Figure 35:
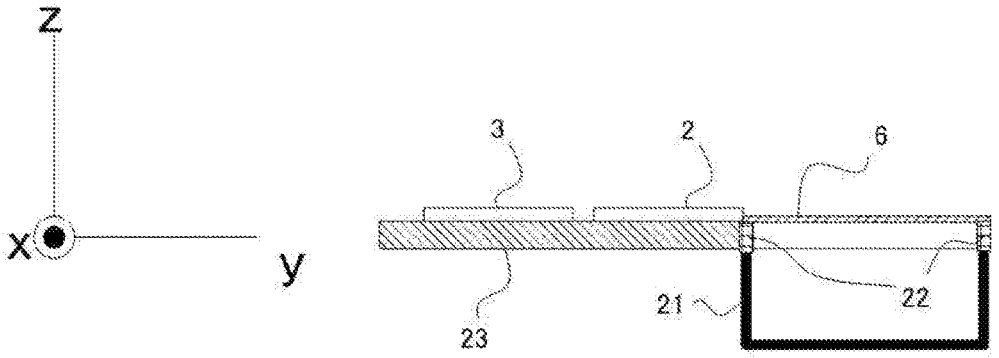
FIG. 35 is a side view of an antenna device according to Embodiment 14 and is an example in which a minute loop antenna is formed by inserting a conductor 21 into through holes 22.

Hereinafter, an antenna device according to Embodiment 14 will be described with reference to FIG. 35. FIG. 35 is a side view of the antenna device according to Embodiment 14. The antenna device according to Embodiment 14 is characterized in that through holes 22 are provided in a circuit board 23, a press-fit connection structure is provided at each end portion of a conductor 21 forming a minute loop antenna, and electrical connection is established within each through hole 22 into which the end portion of the conductor 21 is inserted.

Such a configuration eliminates the need for performing soldering as means for electrically connecting the conductor 21 and the circuit board 23, and an electrical connection is established by inserting the end portions of the conductor 21 into the through holes 22. Thus, the work process can be shortened. Furthermore, when the conductor 21 is fixed to a cover of the antenna device beforehand, an operation of mounting the cover of the antenna device and an operation of forming the antenna can be performed simultaneously, so that the work process can be shortened further.

Embodiment 15

Figure 36:
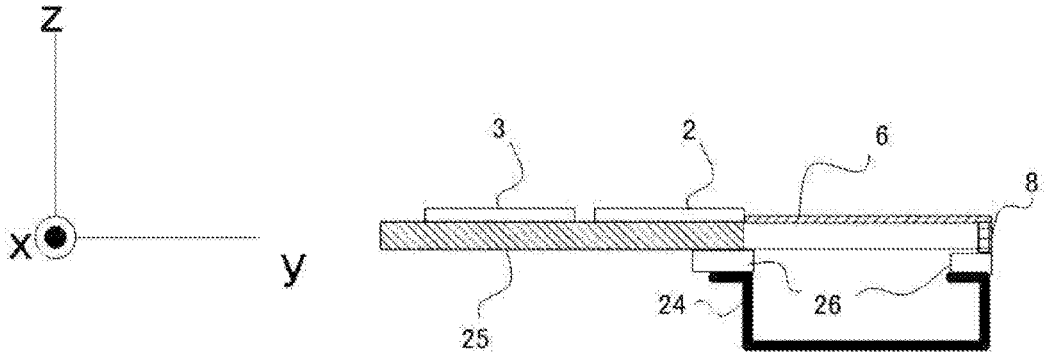
FIG. 36 is another example of a side view of an antenna device according to Embodiment 15 and is an example in which a minute loop antenna is formed by pressing end portions of a conductor 24 against a circuit board 25 via a conductive gasket 26.

Hereinafter, an antenna device according to Embodiment 15 will be described with reference to FIG. 36. FIG. 36 is a side view of the antenna device according to Embodiment 15. The antenna device according to Embodiment 15 is characterized in that end portions of a conductor 24 and a circuit pattern on a circuit board 25 are connected via a gasket formed from a conductive material. In this case as well, the end portions of the conductor 24 and the circuit board 25 are not soldered, and the end portions of the conductor 24 are pressed via the gasket 26, which is formed from a conductive material, by mounting a protective cover (not shown) of the antenna device, whereby an electrical connection is established.

Such a configuration eliminates the need for performing soldering as means for electrically connecting the conductor 24 and the circuit board 25, so that the work process can be shortened. Furthermore, when the conductor 24 is fixed to the protective cover of the antenna device and the gasket 26 is provided on the circuit board 25 beforehand, an operation of mounting the cover of the antenna device and an operation of forming the antenna can be performed simultaneously, so that the work process can be shortened further.

In the description of the present embodiment, an electrical connection is established by pressing the end portions of the conductor 24 against the circuit board 25 via the gasket 26, which is formed from a conductive material, but it is obvious that an electrical connection can be established even by another component. In light of reliability, a spring formed from a conductive material having elasticity, a conductive polymer, or the like may be used. In addition, in the present embodiment, an electrical connection between the end portions of the conductor 24 and the circuit board 25 is ensured only by physical contact, not by soldering, to form the minute loop antenna. Thus, the present embodiment is not limited by the intermediating object and includes the case where the end portions of the conductor 24 and the circuit board 25 are connected via a conductive adhesive and the case where the end portions of the conductor 24 and the circuit board 25 are brought into direct contact with each other.

As described above, the antenna device of the present invention can be made into various forms as shown in Embodiments 1 to 15, but the arrangement of each component can be further changed as long as no circuit pattern is present in the normal direction of the minute loop antenna 1. In addition, as a matter of course, the antenna devices according to Embodiments 1 to 15 can be combined.

Furthermore, each of the antenna devices according to Embodiments 1 to 15 has been described as an antenna device mounted on a portable apparatus of a remote keyless system, but the apparatus to which the antenna device is applied is not limited to the portable apparatus of the remote keyless system. For example, it is effective to use the antenna device as an antenna device mounted in a wireless remote control apparatus that is operated by a user while the user directs the control apparatus toward an apparatus to be controlled. Moreover, although the portable apparatus that emits radio waves from the minute loop antenna 1 has been taken as an example in the description of the antenna device of the present invention, it is obvious that, because of the reciprocity of the antenna device, for example, also in the case of applying the antenna device to a receiver provided at the vehicle side, the same effects as described above can be obtained.

DESCRIPTION OF THE REFERENCE CHARACTERS

1 minute loop antenna
2 feeder circuit (transmitting circuit)
3 switch
4 circuit board
5 ground
6 conductor pattern (first conductor pattern)
9 conductor pattern (second conductor pattern)
12 LF communication coil
14 resinous component
15 conductor
16 resinous component
17 conductor
18 resinous component
19 conductor
20 terminal portion
21 conductor
22 through hole
23 circuit board
24 conductor
25 circuit board
26 gasket
27 protective cover (protective casing)
28 guide portion
30 balanced-to-unbalanced conversion circuit
40 oscillator
60 capacitor
61 inductor
101 first conductor
102 second conductor
103 connection portion
106 through hole
109 first pad
110 second pad
140 groove
141, 142, 143 resinous component
151, 152, 153 conductor
1071, 1081 arm (support means)
1411 guide
1421 projection
1431 guide having claw
1521 hole

The invention claimed is:

1. An antenna device comprising:

a circuit board;

a circuit pattern formed by a conductor on a surface of the circuit board; and a small loop antenna mounted on the circuit board and formed in a loop shape by a conductor having two end portions, wherein the circuit pattern includes at least a feeder circuit configured to supply power to the small loop antenna, and a ground, and the small loop antenna is mounted on the circuit board such that:

the conductor having the two end portions is connected at one end thereof to the feeder circuit and connected at another end thereof to the ground, a loop surface of the conductor having the two end portions is perpendicular to a plane on which the circuit pattern is formed, and no normal line passing through the loop surface passes through the circuit pattern.

2. The antenna device according to claim 1, wherein the small loop antenna is formed of: i) a first conductor provided above the circuit board, and ii) a second conductor provided below the circuit board, the first conductor is connected at one end thereof to the feeder circuit and connected at another end thereof to an end portion of the second conductor, and the second conductor is connected to the ground on the circuit board at an end portion thereof opposite to the end portion connected to the first conductor.

3. The antenna device according to claim 2, wherein at least either one of the first conductor or the second conductor of the small loop antenna is formed by a conductor pattern on the circuit board.

4. The antenna device according to claim 2, wherein the circuit board includes a through hole electrically connecting an end portion of the first conductor and the end portion of the second conductor.

5. The antenna device according to claim 4, wherein a press-fit connection structure is provided at the end portion of the conductor of the small loop antenna which end portion is inserted into the through hole provided in the circuit board.

6. The antenna device according to claim 2, further comprising support means, provided on the circuit board, for supporting at least one of the first conductor and the second conductor.

7. The antenna device according to claim 1, wherein the end portion of the small loop antenna which end portion is connected to the feeder circuit is provided on the circuit board and at a midpoint of a width in a normal direction of the loop surface of the small loop antenna.

8. The antenna device according to claim 1, wherein the small loop antenna is connected to the circuit pattern via a balanced-to-unbalanced conversion circuit.

9. The antenna device according to claim 1, wherein the conductor of the small loop antenna has a length equal to or less than 1/10 of a wavelength of a radio wave emitted by the small loop antenna.

10. The antenna device according to claim 1, further comprising a capacitor, provided between the small loop antenna and the feeder circuit or between the small loop antenna and the ground, for providing impedance matching.

11. The antenna device according to claim 1, further comprising an inductor, provided in parallel with respect to a feeding point at which the feeder circuit and the small loop antenna are connected to each other, for providing impedance matching between the feeder circuit and the small loop antenna.

12. The antenna device according to claim 1, wherein the small loop antenna is formed by a wire-like conductor.

13. The antenna device according to claim 1, wherein the small loop antenna is formed in a shape symmetrical with respect to the plane on which the circuit pattern on the circuit board is formed.

14. The antenna device according to claim 1, wherein the circuit board is formed in an elongated shape, the circuit pattern includes a switch configured to control the feeder circuit, the small loop antenna is provided at an end, in a longitudinal direction, of the circuit board, and the switch is formed at an end of the circuit board which end is opposite to the end at which the small loop antenna is provided.

15. The antenna device according to claim 1, further comprising a resinous component, provided on the circuit board within the loop surface formed by the small loop antenna, for holding the small loop antenna.

16. The antenna device according to claim 15, wherein the resinous component has a groove for fitting and holding the conductor of the small loop antenna.

17. The antenna device according to claim 15, wherein the resinous component has a guide for sandwiching and holding the conductor of the small loop antenna.

18. The antenna device according to claim 15, wherein the conductor of the small loop antenna has a hole, and the resinous component has a projection fitted into the hole of the conductor of the small loop antenna to hold the conductor of the small loop antenna.

19. The antenna device according to claim 15, wherein the resinous component holds the conductor of the small loop antenna formed on a surface of the resinous component by printing with a conductive ink.

20. The antenna device according to claim 15, wherein the resinous component holds the conductor of the small loop antenna through insert molding, and has, on a surface thereof, a terminal portion electrically connected to the circuit board.

21. The antenna device according to claim 1, further comprising a cover for protecting the small loop antenna, wherein the cover has a guide for sandwiching and holding the small loop antenna.

22. The antenna device according to claim 1, further comprising a cover for protecting the small loop antenna, wherein when the cover is mounted, the cover presses the end portion of the conductor of the small loop antenna against the circuit pattern to electrically connect the end portion to the circuit pattern.

23. A manufacturing method for an antenna device including a small loop antenna configured to emit a radio wave when power is supplied thereto, the manufacturing method comprising:

a step of forming, on a circuit board, a circuit pattern including a feeder circuit configured to supply the power to the small loop antenna, and a ground; and a connection step of connecting one end of a first conductor which is bent beforehand to the feeder circuit, connecting another end of the first conductor to a second conductor which is bent beforehand, and connecting an end portion of the second conductor which end portion is opposite to an end portion connected to the first conductor, to the ground on the circuit board, to form the small loop antenna, wherein the connection step includes connecting the first conductor and the second conductor to the circuit board such that: i) a loop surface formed by the first conductor and the second conductor is perpendicular to a plane on which the circuit pattern is formed, and ii) no normal line passing through the loop surface passes through the circuit pattern.

* * * * *